US009777412B2

(12) United States Patent
Podhajny

(10) Patent No.: US 9,777,412 B2
(45) Date of Patent: Oct. 3, 2017

(54) ARTICLE OF FOOTWEAR INCLUDING A MONOFILAMENT KNIT ELEMENT WITH A FUSIBLE STRAND

(71) Applicant: NIKE, Inc., Beaverton, OR (US)

(72) Inventor: Daniel A. Podhajny, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/830,933

(22) Filed: Aug. 20, 2015

(65) Prior Publication Data

US 2015/0351483 A1 Dec. 10, 2015

Related U.S. Application Data

(63) Continuation of application No. 14/170,913, filed on Feb. 3, 2014, now Pat. No. 9,145,629.

(51) Int. Cl.
*D04B 1/24* (2006.01)
*A43B 1/04* (2006.01)
(Continued)

(52) U.S. Cl.
CPC ..... *D04B 1/24* (2013.01); *A43B 1/04* (2013.01); *D04B 1/12* (2013.01); *D04B 1/16* (2013.01);
(Continued)

(58) Field of Classification Search
CPC ... D04B 1/05; D04B 1/12; D04B 1/16; D04B 1/24; D04B 21/207; A43B 23/04; A43B 23/042; A43B 23/0255
See application file for complete search history.

(56) References Cited

U.S. PATENT DOCUMENTS 601,192 A 3/1898 Woodside
1,215,198 A 2/1917 Rothstein
(Continued)

FOREIGN PATENT DOCUMENTS

CN 103517647 A 1/2014
CN 204306115 5/2015
(Continued)

OTHER PUBLICATIONS

Declaration of Dr. Edward C. Frederick from the US Patent and Trademark Office Inter Partes Review of U.S. Pat. No. 7,347,011, 178 pages.
(Continued)

*Primary Examiner* — Danny Worrell
(74) *Attorney, Agent, or Firm* — Brinks Gilson & Lione

(57) ABSTRACT

An article of footwear including a full monofilament upper is described. The full monofilament upper incorporates a knitted component including a monofilament knit element. The monofilament knit element is formed by knitting with a monofilament strand. The monofilament knit element is formed of unitary knit construction with the remaining portions of the knitted component, including peripheral portions that are knit using a natural or synthetic twisted fiber yarn. An inlaid tensile element can extend through the knitted component, including portions of the monofilament knit element. The monofilament knit element may be knitted with a monofilament strand according to a variety of knit structures. A fusible strand may be knit with the monofilament knit element. Upon heating, the fusible strand can combine and surround the monofilament strand within the monofilament knit element.

13 Claims, 12 Drawing Sheets

(51) Int. Cl.

| | |
|---|---|
| ***D04B 1/16*** | (2006.01) |
| ***D04B 1/12*** | (2006.01) |
| *A43B 23/04* | (2006.01) |

(52) U.S. Cl.

CPC ..... *A43B 23/042* (2013.01); *D10B 2403/021* (2013.01); *D10B 2403/032* (2013.01); *D10B 2501/043* (2013.01)

(56) References Cited

U.S. PATENT DOCUMENTS

| | | | |
|---|---|---|---|
| 1,597,934 | A | 8/1926 | Stimpson |
| 1,661,321 | A | 3/1928 | Brauer et al. |
| 1,888,172 | A | 11/1932 | Joha |
| 1,902,780 | A | 3/1933 | Holden et al. |
| 1,910,251 | A | 5/1933 | Joha |
| 2,001,293 | A | 5/1935 | Wilson |
| 2,047,724 | A | 7/1936 | Zuckerman |
| 2,147,197 | A | 2/1939 | Glidden |
| 2,314,098 | A | 3/1943 | McDonald |
| 2,330,199 | A | 9/1943 | Basch |
| 2,343,390 | A | 3/1944 | Ushakoff |
| 2,400,692 | A | 5/1946 | Herbert |
| 2,440,393 | A | 4/1948 | Clark |
| 2,569,764 | A | 10/1951 | Jonas |
| 2,586,045 | A | 2/1952 | Hoza |
| 2,608,078 | A | 8/1952 | Anderson |
| 2,641,004 | A | 6/1953 | Whiting et al. |
| 2,675,631 | A | 4/1954 | Doughty |
| 2,811,029 | A | 10/1957 | Conner |
| 2,994,322 | A | 8/1961 | Cullen et al. |
| 3,583,081 | A | 6/1971 | Hayashi |
| 3,694,940 | A | 10/1972 | Stohr |
| 3,704,474 | A | 12/1972 | Winkler |
| 3,766,566 | A | 10/1973 | Tadokoro |
| 3,778,856 | A | 12/1973 | Christie et al. |
| 3,796,066 | A | 3/1974 | Millar |
| 3,952,427 | A | 4/1976 | von den Benken et al. |
| 3,972,086 | A | 8/1976 | Belli et al. |
| 4,027,402 | A | 6/1977 | Liu et al. |
| 4,031,586 | A | 6/1977 | von den Benken et al. |
| 4,211,806 | A | 7/1980 | Civardi et al. |
| 4,232,458 | A | 11/1980 | Bartels |
| 4,255,949 | A | 3/1981 | Thorneburg |
| 4,258,480 | A | 3/1981 | Famolare, Jr. |
| 4,317,292 | A | 3/1982 | Melton |
| 4,373,361 | A | 2/1983 | Thorneburg |
| 4,447,967 | A | 5/1984 | Zaino |
| 4,465,448 | A | 8/1984 | Aldridge |
| 4,607,439 | A | 8/1986 | Harada |
| 4,608,465 | A | 8/1986 | Harada |
| 4,737,396 | A | 4/1988 | Kamat |
| 4,750,339 | A | 6/1988 | Simpson, Jr. et al. |
| 4,756,098 | A | 7/1988 | Boggia |
| 4,785,558 | A | 11/1988 | Shiomura |
| 4,813,158 | A | 3/1989 | Brown |
| 4,842,661 | A | 6/1989 | Miller et al. |
| 5,031,423 | A | 7/1991 | Ikenaga |
| 5,095,720 | A | 3/1992 | Tibbals, Jr. |
| 5,117,567 | A | 6/1992 | Berger |
| 5,152,025 | A | 10/1992 | Hirmas |
| 5,192,601 | A | 3/1993 | Neisler |
| 5,345,638 | A | 9/1994 | Nishida |
| 5,353,524 | A | 10/1994 | Brier |
| 5,371,957 | A | 12/1994 | Gaudio |
| 5,461,884 | A | 10/1995 | Depoe et al. |
| 5,511,323 | A | 4/1996 | Dahlgren |
| 5,572,860 | A | 11/1996 | Mitsumoto et al. |
| 5,575,090 | A | 11/1996 | Condini |
| 5,623,840 | A | 4/1997 | Roell |
| 5,729,918 | A | 3/1998 | Smets |
| 5,735,145 | A | 4/1998 | Pernick |
| 5,746,013 | A | 5/1998 | Fay, Sr. |
| 5,765,296 | A | 6/1998 | Ludemann et al. |
| 5,884,419 | A | 3/1999 | Davidowitz et al. |
| 5,996,189 | A | 12/1999 | Wang |
| 6,029,376 | A | 2/2000 | Cass |
| 6,032,387 | A | 3/2000 | Johnson |
| 6,052,921 | A | 4/2000 | Oreck |
| 6,088,936 | A | 7/2000 | Bahl |
| 6,151,802 | A | 11/2000 | Reynolds |
| 6,170,175 | B1 | 1/2001 | Funk |
| 6,308,438 | B1 | 10/2001 | Throneburg et al. |
| 6,333,105 | B1 | 12/2001 | Tanaka et al. |
| 6,401,364 | B1 | 6/2002 | Burt |
| 6,558,784 | B1 | 5/2003 | Norton et al. |
| 6,588,237 | B2 | 7/2003 | Cole et al. |
| 6,754,983 | B2 | 6/2004 | Hatfield et al. |
| 6,862,820 | B2 | 3/2005 | Farys et al. |
| 6,910,288 | B2 | 6/2005 | Dua |
| 6,922,917 | B2 | 8/2005 | Kerns et al. |
| 6,931,762 | B1 | 8/2005 | Dua |
| D517,297 | S | 3/2006 | Jones et al. |
| 7,051,460 | B2 | 5/2006 | Orei et al. |
| 7,056,402 | B2 | 6/2006 | Koerwien et al. |
| 7,347,011 | B2 | 3/2008 | Dua et al. |
| 7,441,348 | B1 | 10/2008 | Dawson |
| 7,543,397 | B2 | 6/2009 | Kilgore et al. |
| 7,568,298 | B2 | 8/2009 | Kerns |
| 7,682,219 | B2 | 3/2010 | Falla |
| 7,774,956 | B2 | 8/2010 | Dua et al. |
| 8,099,881 | B2 | 1/2012 | Yamamoto |
| 8,173,558 | B2 | 5/2012 | Fukuoka et al. |
| 8,312,644 | B2 | 11/2012 | Peikert et al. |
| 8,327,669 | B2 | 12/2012 | Weihermueller |
| 8,448,474 | B1 | 5/2013 | Tatler et al. |
| 8,490,299 | B2 | 7/2013 | Dua et al. |
| 8,490,436 | B2 | 7/2013 | Chung et al. |
| 8,839,532 | B2 | 9/2014 | Huffa et al. |
| 8,959,959 | B1 * | 2/2015 | Podhajny ..... A43B 1/04 36/47 |
| 8,997,529 | B1 * | 4/2015 | Podhajny ..... D04B 1/16 36/47 |
| 8,997,530 | B1 | 4/2015 | Podhajny |
| 2002/0078599 | A1 | 6/2002 | Delgorgue et al. |
| 2002/0148258 | A1 | 10/2002 | Cole et al. |
| 2003/0126762 | A1 | 7/2003 | Tseng |
| 2003/0191427 | A1 | 10/2003 | Jay et al. |
| 2004/0118018 | A1 | 6/2004 | Dua |
| 2004/0181972 | A1 | 9/2004 | Csorba |
| 2005/0115284 | A1 | 6/2005 | Dua |
| 2005/0193592 | A1 | 9/2005 | Dua et al. |
| 2005/0273988 | A1 | 12/2005 | Christy |
| 2005/0284000 | A1 | 12/2005 | Kerns |
| 2006/0059715 | A1 | 3/2006 | Aveni |
| 2006/0162187 | A1 | 7/2006 | Byrnes et al. |
| 2007/0022627 | A1 | 2/2007 | Sokolowski et al. |
| 2007/0180730 | A1 | 8/2007 | Greene et al. |
| 2007/0294920 | A1 | 12/2007 | Baychar |
| 2008/0017294 | A1 | 1/2008 | Bailey et al. |
| 2008/0078102 | A1 | 4/2008 | Kilgore et al. |
| 2008/0110048 | A1 | 5/2008 | Dua et al. |
| 2008/0189830 | A1 | 8/2008 | Egglesfield |
| 2008/0313939 | A1 | 12/2008 | Ardill |
| 2009/0068908 | A1 | 3/2009 | Hinchcliff |
| 2010/0051132 | A1 | 3/2010 | Glenn |
| 2010/0154256 | A1 | 6/2010 | Dua |
| 2010/0170651 | A1 | 7/2010 | Scherb et al. |
| 2010/0315299 | A1 | 12/2010 | Bibl et al. |
| 2011/0030244 | A1 | 2/2011 | Motawi et al. |
| 2011/0078921 | A1 | 4/2011 | Greene et al. |
| 2012/0222189 | A1 | 9/2012 | Sokolowski et al. |
| 2012/0233882 | A1 | 9/2012 | Huffa et al. |
| 2012/0255201 | A1 | 10/2012 | Little |
| 2013/0055590 | A1 | 3/2013 | Mokos |
| 2013/0145652 | A1 | 6/2013 | Podhajny et al. |
| 2013/0212907 | A1 | 8/2013 | Dua et al. |
| 2013/0269209 | A1 | 10/2013 | Lang et al. |
| 2014/0023786 | A1 | 1/2014 | Hoff et al. |
| 2014/0130374 | A1 | 5/2014 | Minami et al. |
| 2014/0150296 | A1 | 6/2014 | Dua et al. |
| 2014/0230277 | A1 | 8/2014 | Dua et al. |

(56) References Cited

U.S. PATENT DOCUMENTS

| | | | |
|---|---|---|---|
| 2014/0237855 | A1 | 8/2014 | Podhajny et al. |
| 2015/0216253 | A1 | 8/2015 | Podhajny |

FOREIGN PATENT DOCUMENTS

| | | | |
|---|---|---|---|
| DE | 870963 | | 3/1953 |
| DE | 1084173 | | 6/1960 |
| DE | 19738433 | A1 | 4/1998 |
| DE | 19728848 | A1 | 1/1999 |
| EP | 0279950 | A2 | 8/1988 |
| EP | 0448714 | B1 | 10/1991 |
| EP | 0728860 | A1 | 8/1996 |
| EP | 0758693 | A1 | 2/1997 |
| EP | 0898002 | A2 | 2/1999 |
| EP | 1233091 | A1 | 8/2002 |
| EP | 1437057 | A1 | 7/2004 |
| EP | 1563752 | A1 | 8/2005 |
| EP | 1602762 | A1 | 12/2005 |
| EP | 1972706 | A1 | 9/2008 |
| FR | 2171172 | | 9/1973 |
| GB | 538865 | | 8/1941 |
| GB | 2018837 | A | 10/1979 |
| GB | 1603487 | | 11/1981 |
| JP | H06113905 | | 4/1994 |
| JP | H08109553 | | 4/1996 |
| JP | H11302943 | | 11/1999 |
| JP | 2002-294539 | A | 10/2002 |
| JP | 2006-161167 | A | 6/2006 |
| JP | 2011017110 | A | 1/2011 |
| NL | 7304678 | | 10/1974 |
| WO | WO 90/03744 | A1 | 4/1990 |
| WO | WO 97/23142 | A1 | 7/1997 |
| WO | WO 00/32861 | | 6/2000 |
| WO | WO 02/31247 | A1 | 4/2002 |
| WO | WO 2012/125473 | A2 | 9/2012 |
| WO | WO 2015/116296 | A1 | 8/2015 |

OTHER PUBLICATIONS

Eberle, et al., Excerpt of Hannelore, Clothing Technology, 3rd edition, Third English ed, Beuth-Verlag GmnH, 2002, pp. 2-3, 83.

International Preliminary Report on Patentability for Application No. PCT/US2012/028534, mailed on Sep. 17, 2013.

International Preliminary Report on Patentability for Application No. PCT/US2012/028576, mailed on Sep. 17, 2013.

International Search Report and Written Opinion for Application No. PCT/US2009/056795, mailed Apr. 20, 2010.

International Search Report and Written Opinion for Application No. PCT/US2012/028534, mailed Oct. 17, 2012.

International Search Report and Written Opinion for Application No. PCT/US2012/028576, mailed Oct. 1, 2012.

International Search Report and Written Opinion in connection with PCT/US2012/028559 mailed on Oct. 19, 2012.

International Search Report and Written Opinion mailed Feb. 11, 2015 in International Application No. PCT/US2014/065131.

International Search Report and Written Opinion mailed Feb. 11, 2015 in International Application No. PCT/US2014/065140.

International Search Report and Written Opinion mailed Feb. 24, 2015 in International Application No. PCT/US2014/065143.

Letter from Bruce Huffa dated Dec. 23, 2013 (71 Pages).

Spencer D.J., "A Comprehensive Handbook and Practical Guide," in: Knitting Technology, 3rd Edition, Woodhead Publishing Ltd., 2001, 413 pages.

Office Action and English translation from CN Application No. 201410410048X, dated Mar. 28, 2016, 12 pages.

International Preliminary Report on Patentability from corresponding PCT/US2014/065143 dated Aug. 9, 2016, 9 pages.

Office Action and English translation from corresponding ROC (Taiwan) Patent Application No. 103141849 dated Jul. 21, 2016, 24 pages.

* cited by examiner

ARTICLE OF FOOTWEAR INCLUDING A MONOFILAMENT KNIT ELEMENT WITH A FUSIBLE STRAND

CROSS-REFERENCE TO RELATED APPLICATION

This application is a continuation of U.S. patent application Ser. No. 14/170,913, filed on Feb. 3, 2014, entitled "An Article Of Footwear Including A Monofilament Knit Element With A Fusible Strand", the disclosure of which application is hereby incorporated by reference in its entirety.

BACKGROUND

Conventional articles of footwear generally include two primary elements, an upper and a sole structure. The upper is secured to the sole structure and forms a void on the interior of the footwear for comfortably and securely receiving a foot. The sole structure is secured to a lower area of the upper, thereby being positioned between the upper and the ground. In athletic footwear, for example, the sole structure may include a midsole and an outsole. The midsole often includes a polymer foam material that attenuates ground reaction forces to lessen stresses upon the foot and leg during walking, running, and other ambulatory activities. Additionally, the midsole may include fluid-filled chambers, plates, moderators, or other elements that further attenuate forces, enhance stability, or influence the motions of the foot. The outsole is secured to a lower surface of the midsole and provides a ground-engaging portion of the sole structure formed from a durable and wear-resistant material, such as rubber. The sole structure may also include a sockliner positioned within the void and proximal a lower surface of the foot to enhance footwear comfort.

The upper generally extends over the instep and toe areas of the foot, along the medial and lateral sides of the foot, under the foot, and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear, and the upper may incorporate a heel counter to limit movement of the heel.

A variety of material elements (e.g., textiles, polymer foam, polymer sheets, leather, synthetic leather) are conventionally utilized in manufacturing the upper. In athletic footwear, for example, the upper may have multiple layers that each include a variety of joined material elements. As examples, the material elements may be selected to impart stretch-resistance, wear-resistance, flexibility, air-permeability, compressibility, comfort, and moisture-wicking to different areas of the upper. In order to impart the different properties to different areas of the upper, material elements are often cut to desired shapes and then joined together, usually with stitching or adhesive bonding. Moreover, the material elements are often joined in a layered configuration to impart multiple properties to the same areas. As the number and type of material elements incorporated into the upper increases, the time and expense associated with transporting, stocking, cutting, and joining the material elements may also increase. Waste material from cutting and stitching processes also accumulates to a greater degree as the number and type of material elements incorporated into the upper increases. Moreover, uppers with a greater number of material elements may be more difficult to recycle than uppers formed from fewer types and numbers of material elements. By decreasing the number of material elements utilized in the upper, therefore, waste may be decreased while increasing the manufacturing efficiency and recyclability of the upper.

SUMMARY

Various configurations of an article of footwear may have an upper and a sole structure secured to the upper. A knitted component may include a monofilament knit element forming a substantial majority of the upper of the article of footwear. The monofilament knit element is formed of unitary knit construction with the remaining portions of the knitted component.

In one aspect, the invention provides an article of footwear having an upper and a sole structure secured to the upper, the upper including a knitted component comprising: a monofilament knit element formed by at least one monofilament strand, the monofilament knit element forming a substantial majority of the upper and extending through at least a portion of each of a forefoot region, a midfoot region, and a heel region of the article of footwear; and at least one course of the monofilament knit element including a fusible strand.

In another aspect, the invention provides a method of manufacturing an article of footwear having an upper and a sole structure secured to the upper, the upper including a knitted component, the method comprising: knitting a monofilament knit element using at least one monofilament strand, the monofilament knit element forming a substantial majority of the upper and extending through at least a portion of each of a forefoot region, a midfoot region, and a heel region of the article of footwear; and knitting at least one course of the monofilament knit element including a fusible strand with the at least one monofilament strand.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
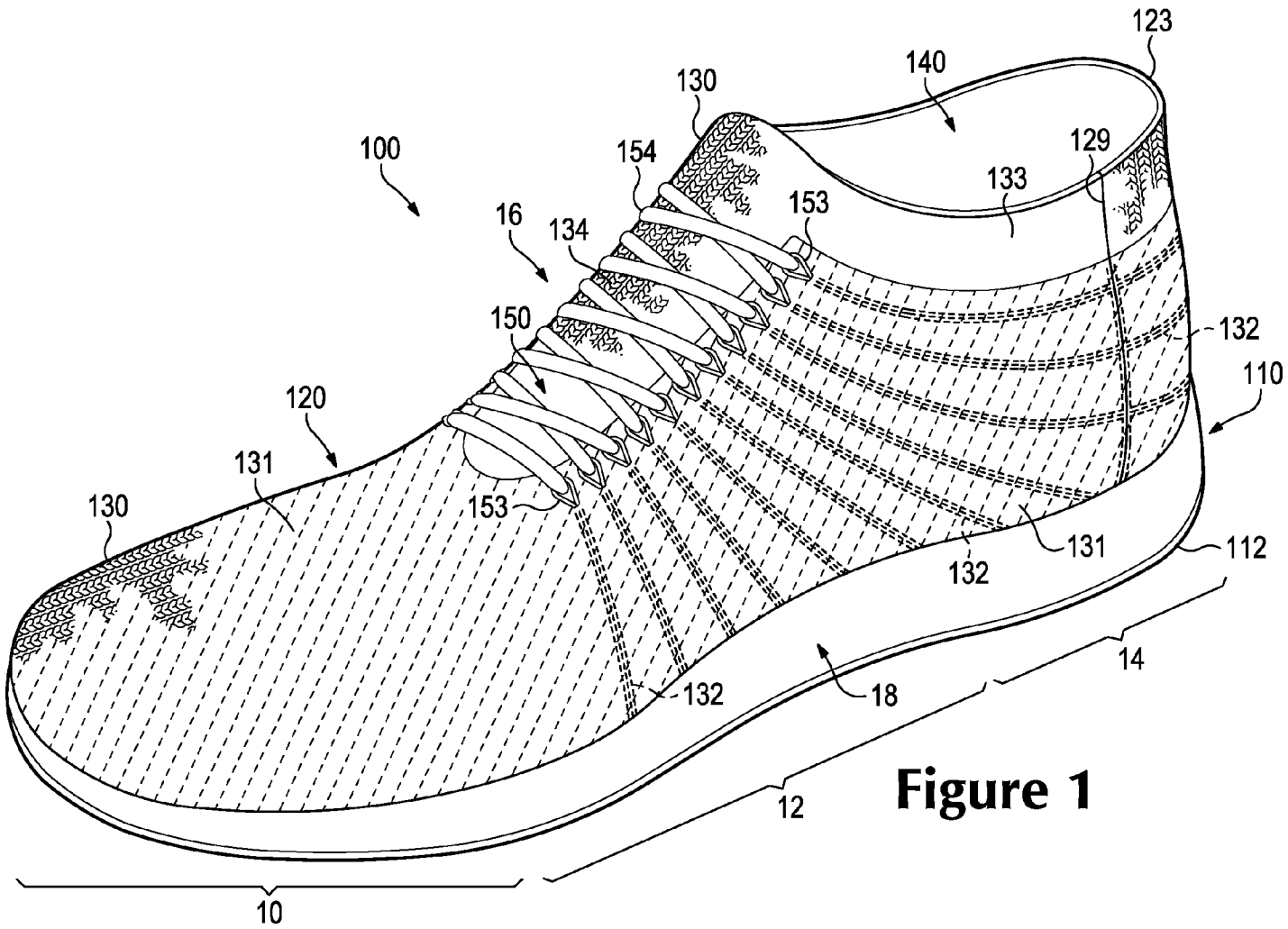
FIG. 1 is an isometric view of an exemplary embodiment of an article of footwear incorporating a full monofilament upper.

The following discussion and accompanying figures disclose a variety of concepts relating to knitted components and the manufacture of knitted components. Although the knitted components may be used in a variety of products, an article of footwear that incorporates one or more of the knitted components is disclosed below as an example. FIGS. 1 through 15B illustrate exemplary embodiments of an article of footwear including a full monofilament upper. The full monofilament upper incorporates a knitted component including a monofilament knit element. The monofilament knit element forms an entirety of a body portion of the knitted component, including the portion of the upper that encloses and surrounds the foot of the wearer, and only peripheral portions of the knitted component, such as collar, tongue, inlaid strands, lace, and logos, tags, or placards, are formed from elements other than the monofilament knit element. The individual features of any of the knitted components described herein may be used in combination or may be provided separately in different configurations for articles of footwear. In addition, any of the features may be optional and may not be included in any one particular embodiment of a knitted component.

FIGS. 1 through 5 illustrate an exemplary embodiment of an article of footwear 100, also referred to simply as article 100. In some embodiments, article of footwear 100 may include a sole structure 110 and an upper 120. Although article 100 is illustrated as having a general configuration suitable for running, concepts associated with article 100 may also be applied to a variety of other athletic footwear types, including soccer shoes, baseball shoes, basketball shoes, cycling shoes, football shoes, tennis shoes, training shoes, walking shoes, and hiking boots, for example. The concepts may also be applied to footwear types that are generally considered to be non-athletic, including dress shoes, loafers, sandals, and work boots. Accordingly, the concepts disclosed with respect to article 100 may be applied to a wide variety of footwear types.

Figure 2:
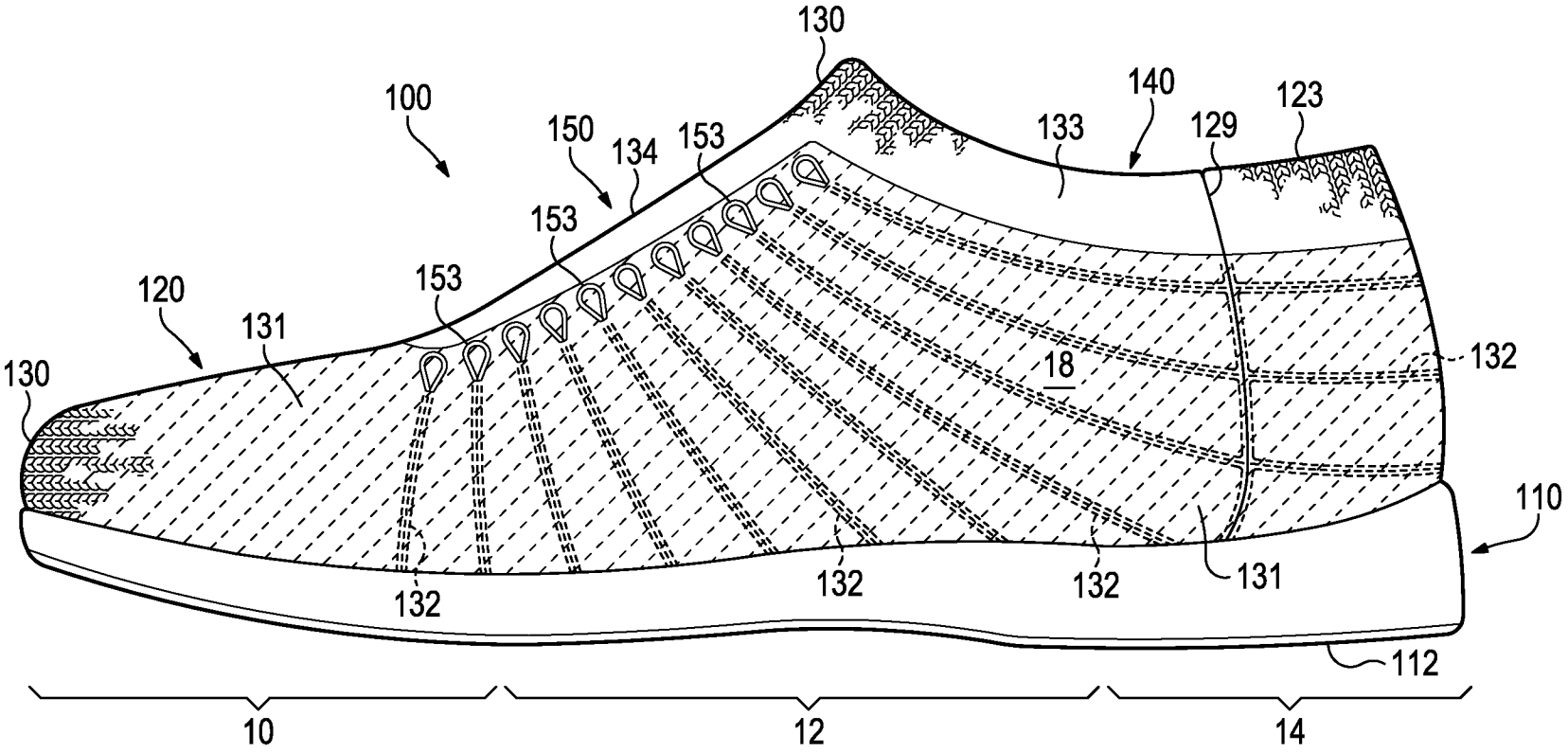
FIG. 2 is a medial side view of the exemplary embodiment of an article of footwear incorporating a full monofilament upper.
Figure 3:
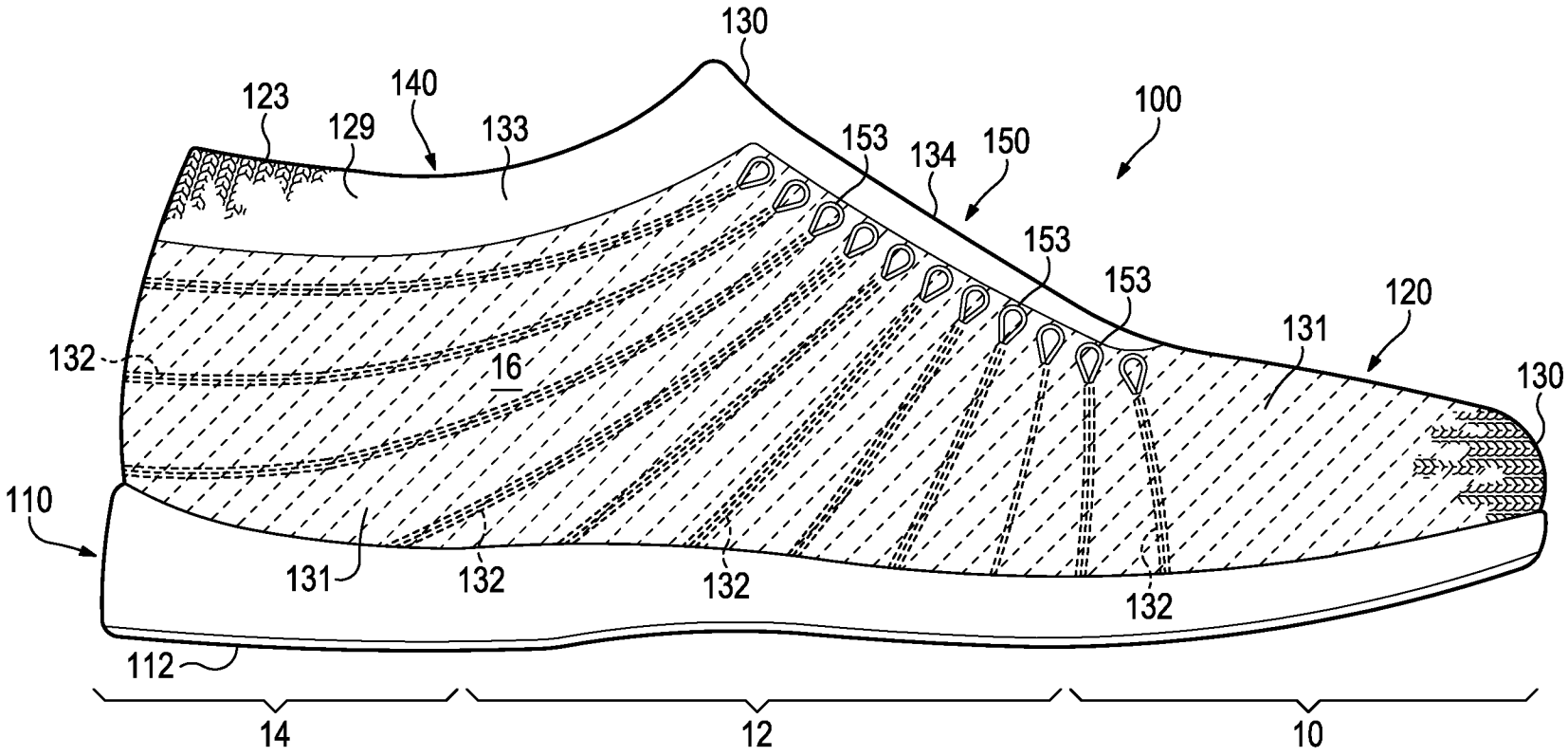
FIG. 3 is a lateral side view of the exemplary embodiment of an article of footwear incorporating a full monofilament upper.
Figure 4:
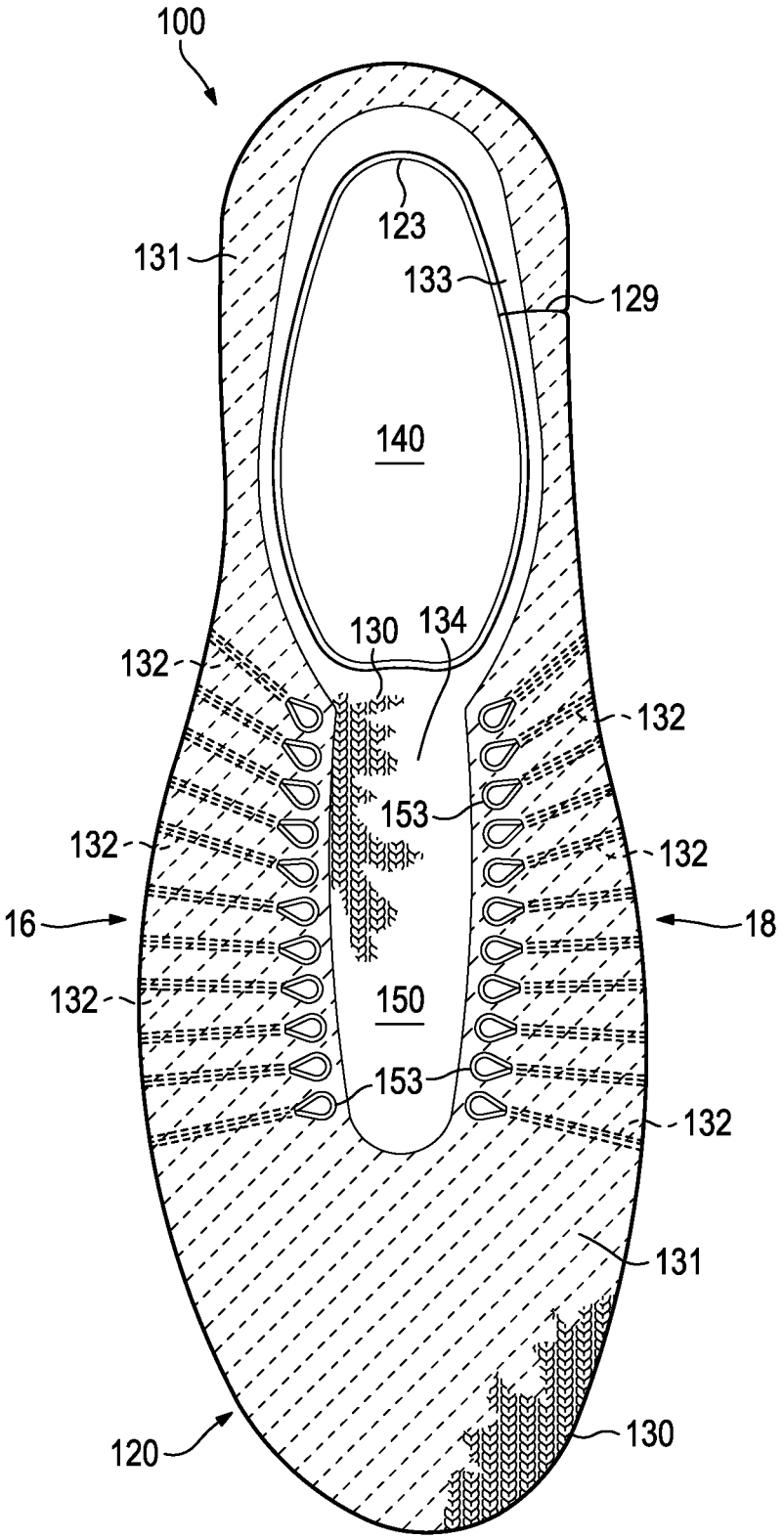
FIG. 4 is a top plan view of the exemplary embodiment of an article of footwear incorporating a full monofilament upper.

For reference purposes, article 100 may be divided into three general regions: a forefoot region 10, a midfoot region 12, and a heel region 14, as shown in FIGS. 1, 2, and 3. Forefoot region 10 generally includes portions of article 100 corresponding with the toes and the joints connecting the metatarsals with the phalanges. Midfoot region 12 generally includes portions of article 100 corresponding with an arch area of the foot. Heel region 14 generally corresponds with rear portions of the foot, including the calcaneus bone. Article 100 also includes a lateral side 16 and a medial side 18, which extend through each of forefoot region 10, midfoot region 12, and heel region 14 and correspond with opposite sides of article 100. More particularly, lateral side 16 corresponds with an outside area of the foot (i.e., the surface that faces away from the other foot), and medial side 18 corresponds with an inside area of the foot (i.e., the surface that faces toward the other foot). Forefoot region 10, midfoot region 12, and heel region 14 and lateral side 16, medial side 18 are not intended to demarcate precise areas of article 100. Rather, forefoot region 10, midfoot region 12, and heel region 14 and lateral side 16, medial side 18 are intended to represent general areas of article 100 to aid in the following discussion. In addition to article 100, forefoot region 10, midfoot region 12, and heel region 14 and lateral side 16, medial side 18 may also be applied to sole structure 110, upper 120, and individual elements thereof.

In an exemplary embodiment, sole structure 110 is secured to upper 120 and extends between the foot and the ground when article 100 is worn. In some embodiments, sole structure 110 may include one or more components, including a midsole, an outsole, and/or a sockliner or insole. In an exemplary embodiment, sole structure 110 may include an outsole 112 that is secured to a lower surface of upper 120 and/or a base portion configured for securing sole structure 110 to upper 120. In one embodiment, outsole 112 may be formed from a wear-resistant rubber material that is textured to impart traction. Although this configuration for sole structure 110 provides an example of a sole structure that may be used in connection with upper 120, a variety of other conventional or nonconventional configurations for sole structure 110 may also be used. Accordingly, in other embodiments, the features of sole structure 110 or any sole structure used with upper 120 may vary.

For example, in other embodiments, sole structure 110 may include a midsole and/or a sockliner. A midsole may be secured to a lower surface of an upper and in some cases may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In other cases, a midsole may incorporate plates, moderators, fluid-filled chambers, lasting elements, or motion control members that further attenuate forces, enhance stability, or influence the motions of the foot. In still other cases, the midsole may be primarily formed from a fluid-filled chamber that is located within an upper and is positioned to extend under a lower surface of the foot to enhance the comfort of an article.

In some embodiments, upper 120 defines a void within article 100 for receiving and securing a foot relative to sole structure 110. The void is shaped to accommodate the foot and extends along a lateral side of the foot, along a medial side of the foot, over the foot, around the heel, and under the foot. Upper 120 includes an exterior surface and an opposite interior surface. Whereas the exterior surface faces outward and away from article 100, the interior surface faces inward and defines a majority or a relatively large portion of the void within article 100 for receiving the foot. Moreover, the interior surface may lay against the foot or a sock covering the foot. Upper 120 may also include a collar 123 that is located in at least heel region 14 and forms a throat opening 140. Access to the void is provided by throat opening 140. More particularly, the foot may be inserted into upper 120 through throat opening 140 formed by collar 123, and the foot may be withdrawn from upper 120 through throat opening 140 formed by collar 123. In some embodiments, an instep area 150 extends forward from collar 123 and throat opening 140 in heel region 14 over an area corresponding to an instep of the foot in midfoot region 12 to an area adjacent to forefoot region 10.

In some embodiments, upper 120 may include a throat portion 134. Throat portion 134 may be disposed between lateral side 16 and medial side 18 of upper 120 through instep area 150. In an exemplary embodiment, throat portion 134 may be integrally attached to and formed of unitary knit construction with portions of upper 120 along lateral and medial sides through instep area 150. Accordingly, as shown in the Figures, upper 120 may extend substantially continuously across instep area 150 between lateral side 16 and medial side 18. In other embodiments, throat portion 134 may be disconnected along lateral and medial sides through instep area 150 such that throat portion 134 is moveable within an opening between a lateral portion and a medial portion on opposite sides of instep area 150, thereby forming a tongue.

A lace 154 extends through a plurality of lace apertures 153 in upper 120 and permits the wearer to modify dimensions of upper 120 to accommodate proportions of the foot. In some embodiments, lace 154 may extend through lace apertures 153 that are disposed along either side of instep area 150. More particularly, lace 154 permits the wearer to tighten upper 120 around the foot, and lace 154 permits the wearer to loosen upper 120 to facilitate entry and removal of the foot from the void (i.e., through throat opening 140). In addition, throat portion 134 of upper 120 in instep area 150 extends under lace 154 to enhance the comfort of article 100. Lace 154 is illustrated with article 100 in FIG. 1, while in FIGS. 2 through 4, lace 154 may be omitted for purposes of clarity. In further configurations, upper 120 may include additional elements, such as (a) a heel counter in heel region 14 that enhances stability, (b) a toe guard in forefoot region 10 that is formed of a wear-resistant material, and (c) logos, trademarks, and placards with care instructions and material information.

Many conventional footwear uppers are formed from multiple material elements (e.g., textiles, polymer foam, polymer sheets, leather, synthetic leather) that are joined through stitching or bonding, for example. In contrast, in some embodiments, a majority of upper 120 is formed from a knitted component 130, which will be discussed in more detail below. Knitted component 130 may, for example, be manufactured through a flat knitting process and extends through each of forefoot region 10, midfoot region 12, and heel region 14, along both lateral side 16 and medial side 18, over forefoot region 10, and around heel region 14. In an exemplary embodiment, knitted component 130 forms substantially all of upper 120, including the exterior surface and a majority or a relatively large portion of the interior surface, thereby defining a portion of the void within upper 120. In some embodiments, knitted component 130 may also extend under the foot. In other embodiments, however, a strobel sock or thin sole-shaped piece of material is secured to knitted component 130 to form a base portion of upper 120 that extends under the foot for attachment with sole structure 110. In addition, a seam 129 extends vertically through heel region 14, to join edges of knitted component 130.

Although seams may be present in knitted component 130, a majority of knitted component 130 has a substantially seamless configuration. Moreover, knitted component 130 may be formed of unitary knit construction. As utilized herein, a knitted component (e.g., knitted component 130) is defined as being formed of "unitary knit construction" when formed as a one-piece element through a knitting process. That is, the knitting process substantially forms the various features and structures of knitted component 130 without the need for significant additional manufacturing steps or processes. A unitary knit construction may be used to form a knitted component having structures or elements that include one or more courses of yarn, strands, or other knit material that are joined such that the structures or elements include at least one course in common (i.e., sharing a common yarn) and/or include courses that are substantially continuous between each of the structures or elements. With this arrangement, a one-piece element of unitary knit construction is provided.

Although portions of knitted component 130 may be joined to each other (e.g., edges of knitted component 130 being joined together) following the knitting process, knitted component 130 remains formed of unitary knit construction because it is formed as a one-piece knit element. Moreover, knitted component 130 remains formed of unitary knit construction when other elements (e.g., a lace, logos, trademarks, placards with care instructions and material information, structural elements) are added following the knitting process.

In some embodiments, upper 120 may include knitted component 130 having one or more portions that include monofilament strands, as will be described in more detail below. Monofilament strands may be made from a plastic or polymer material that is extruded to form the monofilament strand. Generally, monofilament strands may be lightweight and have a high tensile strength, i.e., are able to sustain a large degree of stress prior to tensile failure or breaking, so as to provide a large amount or degree of resistance to stretch to upper 120. In an exemplary embodiment, upper 120 may be a full monofilament upper formed by knitting knitted component 130 with monofilament strands.

In some embodiments, full monofilament upper 120 may comprise knitted component 130 having a monofilament knit element 131 formed using monofilament strands. In one embodiment, full monofilament upper 120 comprises monofilament knit element 131 that forms a substantial majority of upper 120 for article of footwear 100. In some embodiments, the primary elements of knitted component 130 are monofilament knit element 131 and an inlaid tensile element 132. Monofilament knit element 131 may be formed from at least one monofilament strand that is manipulated (e.g., with a knitting machine) to form a plurality of intermeshed loops that define a variety of courses and wales. That is, monofilament knit element 131 has the structure of a knit textile. Inlaid tensile element 132 extends through monofilament knit element 131 and passes between the various loops within monofilament knit element 131. Although inlaid tensile element 132 generally extends along courses within monofilament knit element 131, inlaid tensile element 132 may also extend along wales within monofilament knit element 131. Inlaid tensile element 132 may impart stretch-resistance and, when incorporated into article 100, operates in connection with lace 154 to enhance the fit of article 100. In an exemplary embodiment, inlaid tensile element 132 may pass through one or more portions of monofilament knit element 131.

In some embodiments, inlaid tensile element 132 may extend upwards through monofilament knit element 131 in a vertical direction from sole structure 110 towards instep area 150. In an exemplary embodiment, portions of inlaid tensile element 132 may form a loop that serves as lace aperture 153 and then may extend downwards back in the vertical direction from instep area 150 towards sole structure 110. In addition, when article 100 is provided with lace 154, inlaid tensile element 132 may be tensioned when lace 154 is tightened, and inlaid tensile element 132 resists stretch in upper 120. Moreover, inlaid tensile element 132 assists with securing upper 120 around the foot and operates in connection with lace 154 to enhance the fit of article 100. In some embodiments, inlaid tensile element 132 may exit monofilament knit element 131 at one or more portions, including along medial and lateral sides of instep area 150 so as to be exposed on the exterior surface of upper 120.

Knitted component 130 shown in FIGS. 1 through 6 may include multiple components, structures or elements. In an exemplary embodiment, full monofilament upper 120 comprises knitted component 130 having monofilament knit element 131, as described above, as well as additional peripheral portions, including throat portion 134 and a collar portion 133. In some embodiments, monofilament knit element 131 forms a substantial majority of upper 120, extending through each of forefoot region 10, midfoot region 12, and heel region 14, and extending across upper 120 from lateral side 16 to medial side 18. In addition, monofilament knit element 131 extends over the top of the foot, as well as underneath the bottom of the foot. With this configuration, monofilament knit element 131 forms an interior void for receiving the foot within upper 120 of article of footwear 100.

In one embodiment, monofilament knit element 131 may form substantially all or an entirety of upper 120. For example, with the exception of peripheral portions of upper 120, including throat portion 134, collar portion 133 extending around the ankle of the foot of the wearer, lace 154, and additional components such as logos, trademarks, and placards or tags with care instructions and material information, the remaining portion of upper 120 is formed entirely from knitted monofilament strands of monofilament knit element 131.

The remaining portions of knitted component 130 other than monofilament knit element 131, including peripheral portions such as throat portion 134 and collar portion 133, may incorporate various types of yarn that impart different properties to separate areas of upper 120. That is, one area of knitted component 130 may be formed from a first type of yarn that imparts a first set of properties, and another area of knitted component 130 may be formed from a second type of yarn that imparts a second set of properties. In an exemplary embodiment, peripheral portions of knitted component 130, including throat portion 134 and collar portion 133, may be formed from the first type of yarn and/or the second type of yarn. With this configuration, properties may vary throughout upper 120 by selecting specific yarns for different areas of knitted component 130.

The properties that a particular type of yarn will impart to an area of knitted component 130 partially depend upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high strength. Polyester is a hydrophobic material that also provides relatively high durability. In addition to materials, other aspects of the yarns selected for knitted component 130 may affect the properties of upper 120. For example, a yarn forming knitted component 130 may include separate filaments that are each formed of different materials. In addition, the yarn may include filaments that are each formed of two or more different materials, such as a bicomponent yarn with filaments having a sheath-core configuration or two halves formed of different materials. Different degrees of twist and crimping, as well as different deniers, may also affect the properties of upper 120. Accordingly, both the materials forming the yarn and other aspects of the yarn may be selected to impart a variety of properties to separate areas of upper 120.

In some configurations of knitted component 130, materials forming yarns may be non-fusible or fusible. For example, a non-fusible yarn may be substantially formed from a thermoset polyester material and fusible yarn may be at least partially formed from a thermoplastic polyester material. When a fusible yarn is heated and fused to non-fusible yarns, this process may have the effect of stiffening or rigidifying the structure of knitted component 130. Moreover, joining portions of non-fusible yarn using fusible yarns may have the effect of securing or locking the relative positions of non-fusible yarns within knitted component 130, thereby imparting stretch-resistance and stiffness. That is, portions of non-fusible yarn may not slide relative to each other when fused with the fusible yarn, thereby preventing warping or permanent stretching of knitted component 130 due to relative movement of the knit structure. Another feature of using fusible yarns in portions of knitted component 130 relates to limiting unraveling if a portion of knitted component 130 becomes damaged or one of the non-fusible yarns is severed. Accordingly, areas of knitted component 130 may be configured with both fusible and non-fusible yarns within the knit structure.

In an exemplary embodiment, upper 120 may include a first type of yarn that is knitted to form portions of knitted component 130 other than monofilament knit element 131. In one embodiment, peripheral portions of knitted component 130, including throat portion 134 and collar portion 133, are formed by knitting with the first type of yarn. In an exemplary embodiment, the first type of yarn is a natural or synthetic twisted fiber yarn. In contrast, monofilament knit element 131 incorporated into upper 120 may be formed by knitting with one or more monofilament strands to form knitted component 130 of unitary knit construction with the peripheral portions of knitted component 130 knitted with the first type of yarn. That is, monofilament knit element 131 is formed of unitary knit construction with the remaining portions of knitted component 130 so as to be a one-piece element. Accordingly, in this embodiment, monofilament knit element 131 is formed of unitary knit construction with throat portion 134 and collar portion 133 so as to be a one-piece element.

In some embodiments, knitted component 130 may include one or more boundary zones. A boundary zone defines the portion of knitted component 130 where the yarn used to knit knitted component 130 transitions from one yarn type to another yarn type. For example, knitted component 130 may transition from a first type of yarn to a monofilament strand forming monofilament knit element 131 at one or more boundary zones on upper 120. In an exemplary embodiment, the first type of yarn transitions from a natural or synthetic twisted fiber yarn to the monofilament strand at one or more boundary zones around collar portion 133 and/or along instep area 150 on either side of throat portion 134.

Figure 5:
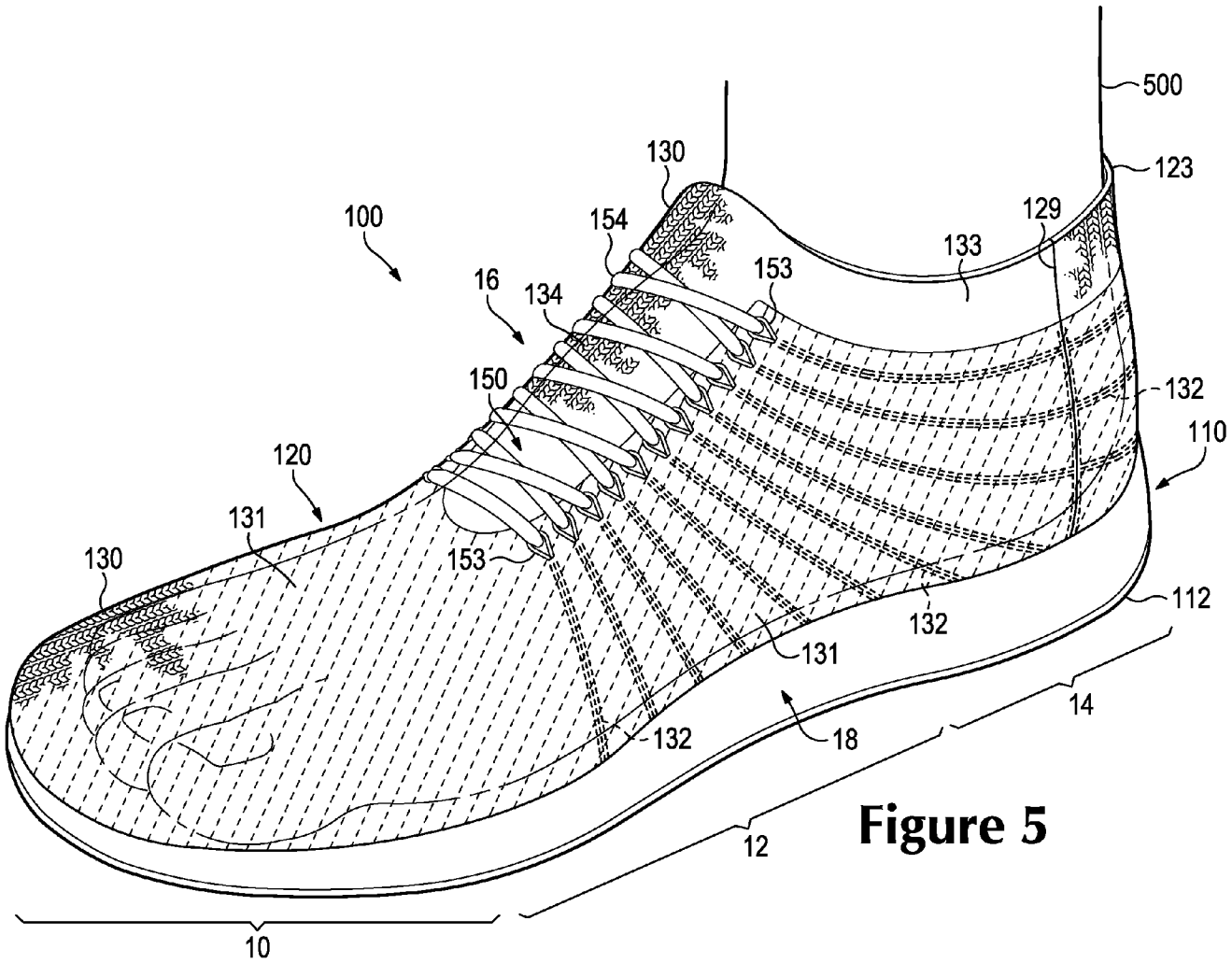
FIG. 5 is a representational view of the exemplary embodiment of an article of footwear incorporating a full monofilament upper with a foot disposed within.

In some embodiments, monofilament strands forming monofilament knit element 131 of upper 120 may be transparent, translucent, or opaque depending on the characteristics or properties of the material used to make the monofilament strand. In an exemplary embodiment, monofilament knit element 131 may be formed using monofilament strands that are transparent, semi-transparent, and/or translucent, so that at least some details of a foot of a wearer from within the interior of article 100 may be visible through upper 120. For example, FIG. 5 shows a representational view of article of footwear 100 incorporating full monofilament upper 120 with a foot 500 disposed within the interior. In this embodiment, details of foot 500 may be seen through monofilament knit element 131 forming upper 120. While in FIG. 5 foot 500 is shown barefoot, it should be understood that details of a sock or stocking worn on foot 500 may similarly been seen through monofilament knit element 131 forming upper 120.

In some embodiments, the amount of details or visibility of foot 500 through upper 120 may be modified by selecting a monofilament strand that has a different level or amount of transparency or translucency. For example, a smoked or tinted monofilament strand may provide less transparency than a clear monofilament strand. Similarly, a darker colored or tinted monofilament strand may provide less translucency than a smoked or lightly tinted monofilament strand. Additionally, an opaque or solid colored monofilament strand may provide very little to no translucency. In different embodiments, therefore, the level of transparency or translucency of the monofilament strands forming monofilament knit element 131 may be varied to provide associated levels or amounts of transparency or translucency to desired portions of upper 120.

Figure 6:
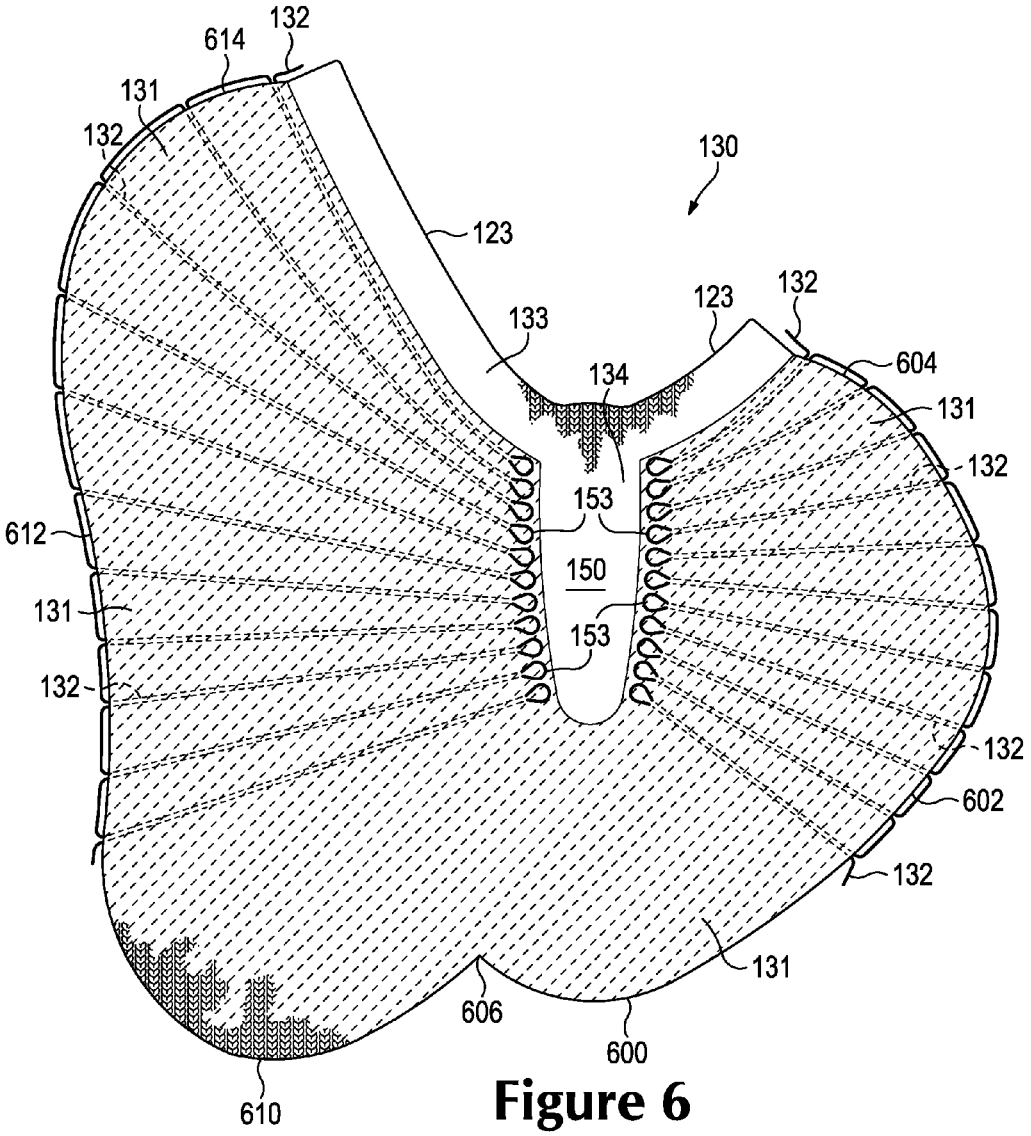
FIG. 6 is a top plan view of an exemplary embodiment of a knitted component including a monofilament knit element.

Referring now to FIG. 6, knitted component 130 is shown in a planar or flat configuration. As described above, knitted component 130 includes monofilament knit element 131 and inlaid tensile element 132. In an exemplary embodiment, knitted component 130 may have an oblong offset configuration that is outlined by an outer perimeter. In this embodiment, the outer perimeter includes a top forefoot perimeter edge 600, a top side perimeter edge 602, a pair of heel edges, including a medial heel edge 604 and a lateral heel edge 614, a bottom side perimeter edge 612, and a bottom forefoot perimeter edge 610. In an exemplary embodiment, knitted component 130 may further include an inner perimeter edge along collar 123 that will be associated with and define throat opening 140, described above.

In addition, monofilament knit element 131 has a first side forming a portion of the exterior surface of upper 120 and an opposite second side that may form a portion of the interior surface of upper 120, thereby defining at least a portion of the void within upper 120. In many configurations, inlaid tensile element 132 may extend through portions of monofilament knit element 131, including portions between the first side and the second side of monofilament knit element 131.

As shown in FIG. 6, inlaid tensile element 132 repeatedly extends from top side perimeter edge 602 toward instep area 150, where a portion of inlaid tensile element 132 forms a loop to serve as lace aperture 153, and back to top side perimeter edge 602. Inlaid tensile element 132 may follow a similar path on the opposite side of knitted component 130. In this embodiment, inlaid tensile element 132 repeatedly extends from bottom side perimeter edge 612 toward instep area 150, where a portion of inlaid tensile element 132 forms a loop to serve as lace aperture 153, and back to bottom side perimeter edge 612. In some embodiments, portions of inlaid tensile element 132 may angle rearwards and extend to medial heel edge 604 and/or lateral heel edge 614.

In comparison with monofilament knit element 131, inlaid tensile element 132 may exhibit greater stretch-resistance. That is, inlaid tensile element 132 may stretch less than monofilament knit element 131. Given that numerous sections of inlaid tensile element 132 extend through monofilament knit element 131, inlaid tensile element 132 may impart stretch-resistance to portions of upper 120 between instep area 150 and a lower area adjacent to sole structure 110. Moreover, placing tension upon lace 154 may impart tension to inlaid tensile element 132, thereby inducing the portions of upper 120 between instep area 150 and the lower area to lay against the foot. Additionally, given that numerous sections of inlaid tensile element 132 extend toward medial heel edge 604 and/or lateral heel edge 614, inlaid tensile element 132 may impart stretch-resistance to portions of upper 120 in heel region 14. As such, inlaid tensile element 132 operates in connection with lace 154 to enhance the fit of article 100.

In some embodiments, the configuration of inlaid tensile element 132 may vary significantly. In addition to yarn, inlaid tensile element 132 may have the configurations of a filament (e.g., a monofilament), thread, rope, webbing, cable, or chain, for example. In comparison with the monofilament strands forming monofilament knit element 131, the thickness of inlaid tensile element 132 may be greater. In some configurations, inlaid tensile element 132 may have a significantly greater thickness than the monofilament strands of monofilament knit element 131. Although the cross-sectional shape of inlaid tensile element 132 may be round, triangular, square, rectangular, elliptical, or irregular shapes may also be utilized. Moreover, the materials forming inlaid tensile element 132 may include any of the materials for the first type of yarn or second type of yarn, discussed above, such as cotton, elastane, polyester, rayon, wool, and nylon. As noted above, inlaid tensile element 132 may exhibit greater stretch-resistance than monofilament knit element 131. As such, suitable materials for inlaid tensile element 132 may include a variety of engineering filaments that are utilized for high tensile strength applications, including glass, aramids (e.g., para-aramid and meta-aramid), ultra-high molecular weight polyethylene, and liquid crystal polymer. As another example, a braided polyester thread may also be utilized as inlaid tensile element 132.

U.S. Patent Application Publication 2012/0233882 to Huffa, et al., the disclosure of which is incorporated herein in its entirety, provides a discussion of the manner in which a knitted component (e.g., knitted component 130) may be formed, including the process of inlaying or otherwise locating inlaid tensile element within a knit element.

In an exemplary embodiment, one or more of the perimeter edges of knitted component 130 may be joined to form upper 120. In this embodiment, knitted component 130 may be folded at a folding point 606 between top forefoot perimeter edge 600 and bottom forefoot perimeter edge 610 to place top forefoot perimeter edge 600 and bottom forefoot perimeter edge 610 in contact with each other. Similarly, top side perimeter edge 602 may be placed in contact with bottom side perimeter edge 612 and pair of heel edges, medial heel edge 604 and lateral heel edge 614, may be placed in contact with each other. In an exemplary embodiment, medial heel edge 604 and lateral heel edge 614 may be joined along seam 129 disposed along medial side 18 of upper 120 in heel region 14. In addition, seam 129 may further extend along and connect each of top forefoot perimeter edge 600 and bottom forefoot perimeter edge 610 and top side perimeter edge 602 and bottom side perimeter edge 612 to form upper 120.

In an exemplary embodiment, knitted component 130 may include peripheral portions, including throat portion 134 and collar portion 133, that are not formed using the monofilament strands forming monofilament knit element 131, but remain formed of unitary knit construction with knitted component 130. In this embodiment, collar portion 133 has a curved configuration that forms collar 123 and defines throat opening 140 when upper 120 is incorporated into article 100. In an exemplary embodiment, collar portion 133 may extend substantially continuously along the inner perimeter of knitted component 130. As described above, in one embodiment, collar portion 133 may be formed by knitting with a yarn that includes a natural or synthetic twisted fiber yarn. With this configuration, the yarn of collar portion 133 may be provided around the inner perimeter of knitted component 130 so as to provide comfort to the foot of a wearer when inserted within throat opening 140 and contacting collar 123.

In an exemplary embodiment, throat portion 134 may extend outward from collar portion 133 and extend through at least a portion of a length of instep area 150. As shown in FIG. 6, throat portion 134 may extend substantially continuously between opposite sides of monofilament knit element 131 along the medial side and lateral side of instep area 150. In one embodiment, throat portion 134 also may be formed by knitting with a yarn that includes a natural or synthetic twisted fiber yarn. In some cases, the yarn forming throat portion 134 may be the same as the yarn forming collar portion 133. For example, in one embodiment, collar portion 133 may be formed by the first type of yarn and the throat portion also may be formed by the first type of yarn. In other cases, the yarn forming throat portion 134 may be different than the yarn forming collar portion 133. For example, in one embodiment, collar portion 133 may be formed by the first type of yarn and the throat portion may be formed by the second type of yarn that is different than the first type of yarn. With this configuration, the yarn of throat portion 134 may have different properties from the yarn of collar portion 133, including, for example, additional stretchability provided by using an elastic yarn for throat portion 134. By providing throat portion 134 with a synthetic or natural fiber twisted yarn, the portion of throat portion 134 extending through instep area 150 may provide comfort to a wearer of article 100 when resting against a top of a foot of the wearer.

In some embodiments, collar portion 133 and throat portion 134 may be formed of unitary knit construction with each other, as well as with the remaining portion of knitted component 130, including monofilament knit element 131. That is, courses of monofilament knit element 131 are joined with courses of collar portion 133 and/or throat portion 134, and courses of collar portion 133 and throat portion 134 may also be joined with each other. In this embodiment, a course of a monofilament strand forming monofilament knit element may be joined (e.g., by interlooping) to an adjacent course of the natural or synthetic twisted fiber yarn forming collar portion 133 and/or throat portion 134. That is, a course formed by knitting the monofilament strand is substantially continuous with a course formed by knitting the natural or synthetic twisted fiber yarn. Additionally, in some embodiments, wales of the natural or synthetic twisted fiber yarn may be joined to an adjacent wale of the monofilament strand. In one embodiment, the peripheral portions, including collar portion 133 and/or throat portion 134, may be knit using an intarsia knitting technique to transition between the monofilament strand and various yarn types along boundary zones. For example, wales of the synthetic or natural twisted fiber of throat portion 134 may joined to adjacent wales of the monofilament strand of monofilament knit element 131 by using intarsia knit construction techniques at instep area 150. With this configuration, monofilament knit element 131 may be formed of unitary knit construction with the peripheral portions of knitted component 130, including collar portion 133 and/or throat portion 134, so as to be a one-piece element.

Various monofilament knit structures, incorporating one or more monofilament strands, may be used to form monofilament knit element 131, as will be described in more detail in reference to FIGS. 8 through 15B below. For example, in one embodiment, a single monofilament strand having a diameter of approximately 0.125 mm may be used for forming monofilament knit element 131. In another embodiment, two monofilament strands each having a diameter of approximately 0.08 mm may be used for forming monofilament knit element 131. In other embodiments, monofilament strands having a larger or smaller diameter may be used.

Figure 7:
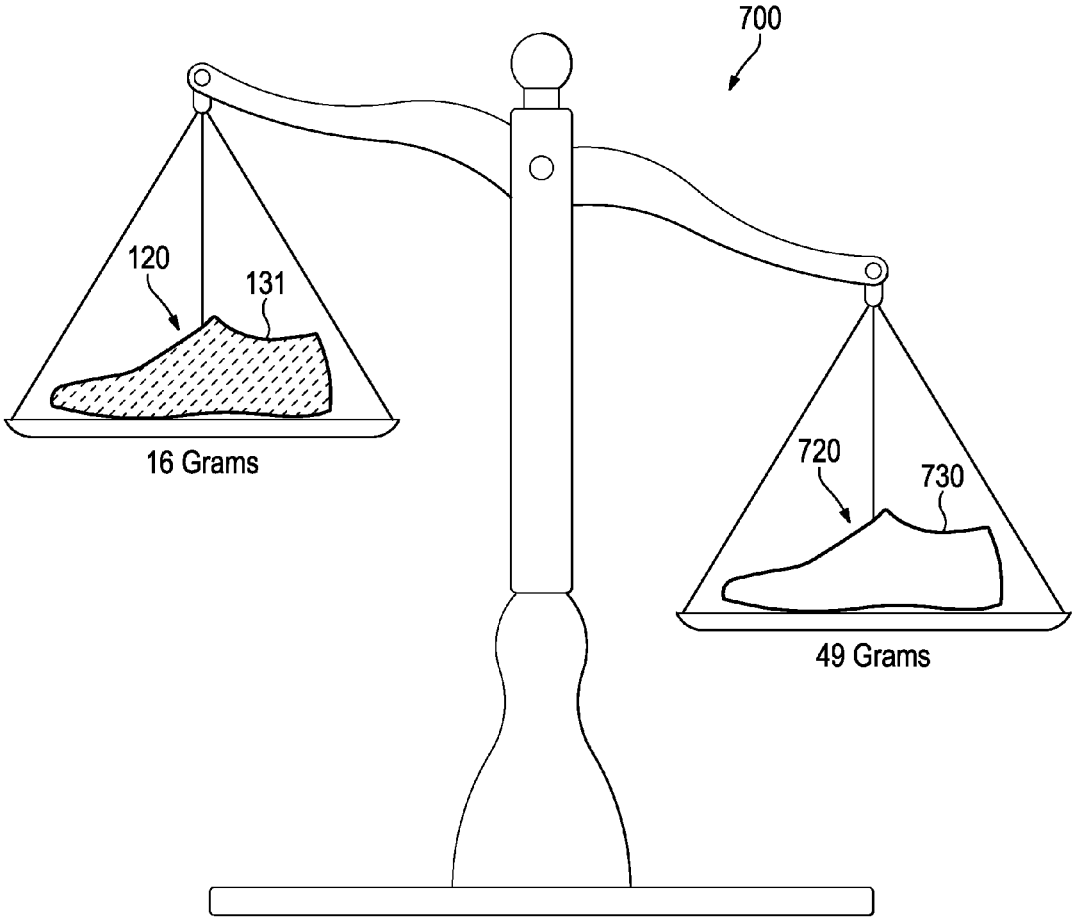
FIG. 7 is a representational view of the relative weights of an exemplary embodiment of a full monofilament upper and an embodiment of a fiber yarn upper.

By incorporating knitted component 130 with monofilament knit element 131 into upper 120 for article 100, monofilament knit element 131 may provide strength, stretch resistance, reduced weight, and/or assist with airflow through upper 120 to provide ventilation to the interior of article 100. Moreover, by forming full monofilament upper 120 such that monofilament knit element 131 forms substantially all or an entirety of upper 120, the overall weight of upper 120 may be significantly reduced compared with an upper formed wholly of a natural or synthetic twisted fiber yarn. FIG. 7 illustrates a representational view of the relative weights of full monofilament upper 120 and an embodiment of a fiber yarn upper 720 shown for emphasis on a balance scale 700. For example, in one embodiment, upper 720 for an adult men's size 8 may weigh approximately 49 grams when knitted with a natural or synthetic twisted fiber yarn to form a fiber yarn knitted component 730. In contrast, full monofilament upper 120 with monofilament knit element 131 may weigh only 16 grams for a similar size. Therefore, the weight savings associated with using the monofilament strand for monofilament knit element 131 forming upper 120 may be lighter by at least 67%. In addition, by varying the number, thickness, and/or size of monofilament strands forming monofilament knit element 131, additional weight savings to increase the reduction in weight to more than 67% may be achieved.

In different embodiments, various knit structures may be used to join courses of monofilament strands to form monofilament knit element 131. Knit structures may include combinations of different knit stitch types, different monofilament strand and/or yarn types, and/or different numbers of strands or yarns to form various kinds of knit structures. FIGS. 8 through 12 illustrate exemplary embodiments of knit structures that may be used with one or more monofilament strands to knit portions of monofilament knit element 131, described above. It should be understood that the knit structures illustrated in FIGS. 8 through 12 are merely exemplary and other conventional knit structures commonly used for natural or synthetic twisted fiber yarn textiles may be used in addition to, in combination with, or in place of, the knit structures disclosed herein for any of the exemplary embodiments.

In some embodiments, knitted component 130 may include monofilament knit element 131 with multiple knit layers. Knit layers associated with knitted component 130 may be partially co-extensive and overlapping portions of monofilament knit element 131 that include at least one common monofilament strand that passes back and forth between the knit layers so as to join and interlock the layers to each other. In an exemplary embodiment, a first knit layer may form a majority of a first side of knitted component 130 and a second knit layer may form a majority of a second side of knitted component 130. In some embodiments, the first knit layer may be associated with a majority of the exterior surface of upper 120 and the second knit layer may be associated with a majority of the interior surface of upper 120. In an exemplary embodiment, inlaid tensile element 132 may extend through portions of the first knit layer, the second knit layer, and/or through portions of monofilament knit element 131 between the first knit layer and the second knit layer. With this configuration, the knit layers together form a single knit textile formed of unitary knit construction.

Figure 8:
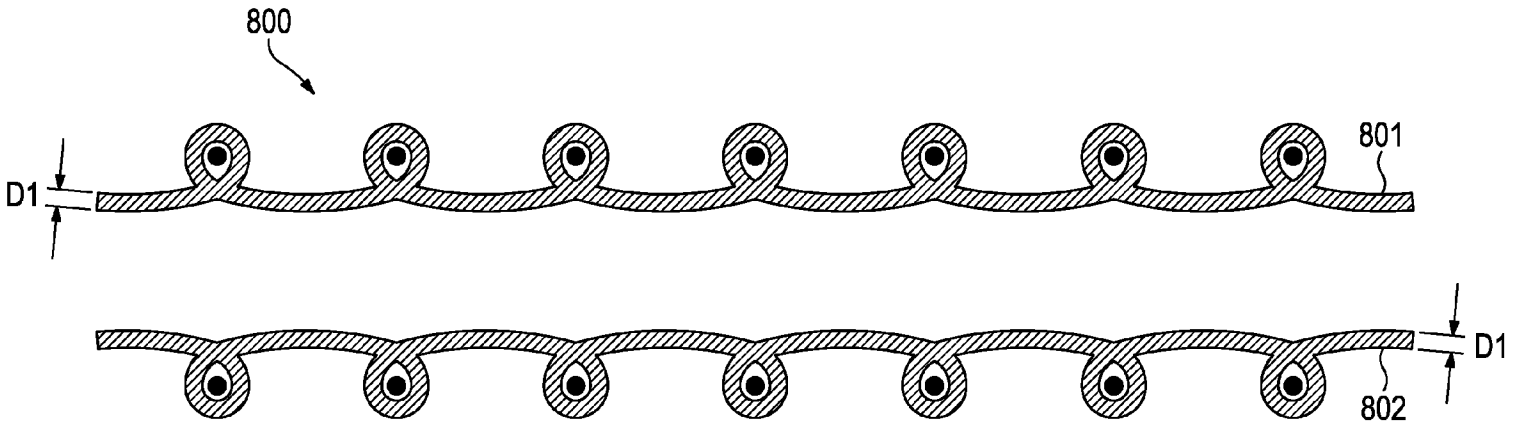
FIG. 8 is a schematic view of a first exemplary embodiment of a knit structure for a monofilament knit element.

Referring now to FIG. 8, a first knit structure 800 that may be used to form portions of monofilament knit element 131 is illustrated. In some embodiments, first knit structure 800 may have the configuration of a double layer knit textile knit on a knitting machine having two needle beds. In the exemplary embodiments described herein, the knitting machine may be a flat bed knitting machine. However, in other embodiments, a different type of knitting machine may be used. In an exemplary embodiment, first knit structure 800 may have the configuration of a double layer jersey knit structure. As shown in FIG. 8, needles on opposite needle beds may each knit stitches associated with the respective knitted layer of first knit structure 800 to form areas of monofilament knit element 131 that have the form of a tubular knit textile.

In some embodiments, first knit structure 800 may be knitted using a single monofilament strand for each knitted layer of monofilament knit element 131. In an exemplary embodiment, first knit structure 800 is knitted using a first monofilament strand 801 that is associated with a first needle bed and a second monofilament strand 802 that is associated with a second needle bed, opposite the first needle bed. As shown in FIG. 8, first monofilament strand 801 forms a first knitted layer and second monofilament strand 802 forms a second knitted layer.

In an exemplary embodiment, first monofilament strand 801 and second monofilament strand 802 may be formed from the same type of monofilament strand. In various embodiments, the thickness of a monofilament strand may be described in terms of a diameter of the strand. In an exemplary embodiment, first monofilament strand 801 and second monofilament strand 802 may be associated with a first diameter D1. In one embodiment, first diameter D1 may be approximately 0.125 mm. In some cases, first monofilament strand 801 and second monofilament strand 802 may be portions of the same monofilament strand. In other cases, first monofilament strand 801 and second monofilament strand 802 may be separate strands of the same type of monofilament strand.

Figure 9:
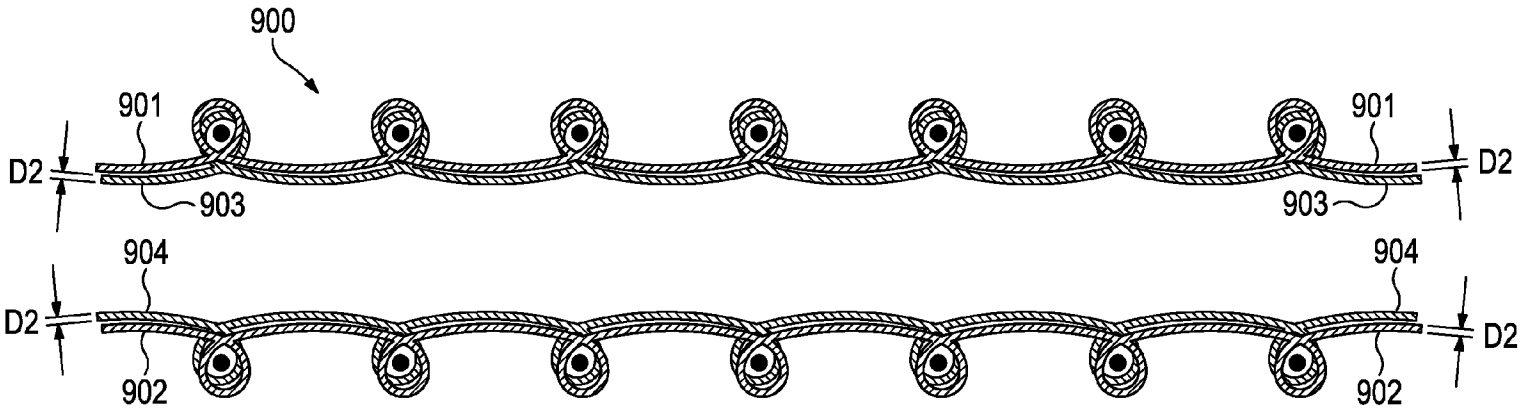
FIG. 9 is a schematic view of a second exemplary embodiment of a knit structure for a monofilament knit element.

Referring now to FIG. 9, a second knit structure 900 that may be used to form portions of monofilament knit element 131 is illustrated. In some embodiments, second knit structure 900 may have the configuration of a double layer knit textile knit on a knitting machine having two needle beds, as with first knit structure 800. In contrast with first knit structure 800, however, second knit structure 900 may be formed using two separate monofilament strands, also referred to as two "ends" of monofilament strands, to form monofilament knit element 131. That is, two monofilament strands are run together through a dispensing tip of a feeder on the knitting machine such that each stitch of second knit structure 900 may be formed using the two monofilament strands together. In an exemplary embodiment, second knit structure 900 also may have the configuration of a double layer jersey knit structure. As shown in FIG. 9, needles on opposite needle beds may each knit stitches associated with the respective knitted layer of second knit structure 900 to form areas of monofilament knit element 131 that have the form of a tubular knit textile.

In some embodiments, second knit structure 900 may be knitted using two ends of monofilament strand for each knitted layer of monofilament knit element 131. In an exemplary embodiment, second knit structure 900 is knitted using a first monofilament strand 901 and a second monofilament strand 903 that are associated with a first needle bed and a third monofilament strand 902 and a fourth monofilament strand 904 that are associated with a second needle bed, opposite the first needle bed. First monofilament strand 901 and second monofilament strand 903 are run together through the dispensing tip of the feeder on the knitting machine to form a first knitted layer associated with second knit structure 900. Similarly, third monofilament strand 902 and fourth monofilament strand 904 are run together through the dispensing tip of the feeder on the knitting machine to form a second knitted layer associated with second knit structure 900.

In an exemplary embodiment, first monofilament strand 901 and second monofilament strand 903, and third monofilament strand 902 and fourth monofilament strand 904, may be formed from the same type of monofilament strand. In addition, in some embodiments, each of first monofilament strand 901, second monofilament strand 903, third monofilament strand 902, and fourth monofilament strand 904 may be formed from the same type of monofilament strand. In an exemplary embodiment, first monofilament strand 901 and second monofilament strand 903 may be associated with a second diameter D2. Similarly, third monofilament strand 902 and fourth monofilament strand 904 may also be associated with second diameter D2. In some embodiments, second diameter D2 may be smaller than first diameter D1 associated with first knit structure 800. In one embodiment, second diameter D2 may be approximately 0.08 mm. In some cases, first monofilament strand 901 and second monofilament strand 903, and third monofilament strand 902 and fourth monofilament strand 904, may be portions of the same monofilament strand. In other cases, first monofilament strand 901 and second monofilament strand 903, and third monofilament strand 902 and fourth monofilament strand 904, may be separate strands of the same type of monofilament strand.

In an exemplary embodiment, second knit structure 900 using two ends of monofilament strands to knit portions of each knitted layer of monofilament knit element 131 may provide improved comfort compared to first knit structure 800 using a single monofilament strand. That is, by using first monofilament strand 901, second monofilament strand 903, third monofilament strand 902, and fourth monofilament strand 904 with second diameter D2 according to second knit structure 900, the separate strands of monofilament are able to shift relative to each other to conform to the surfaces of a foot of a wearer when disposed within article 100. In contrast, thicker monofilament strands 801, 802 with first diameter D1 according to first knit structure 800 above, may form monofilament knit element 131 having sharp or pointed areas that poke into a foot of a wearer when disposed within article 100.

Figure 10:
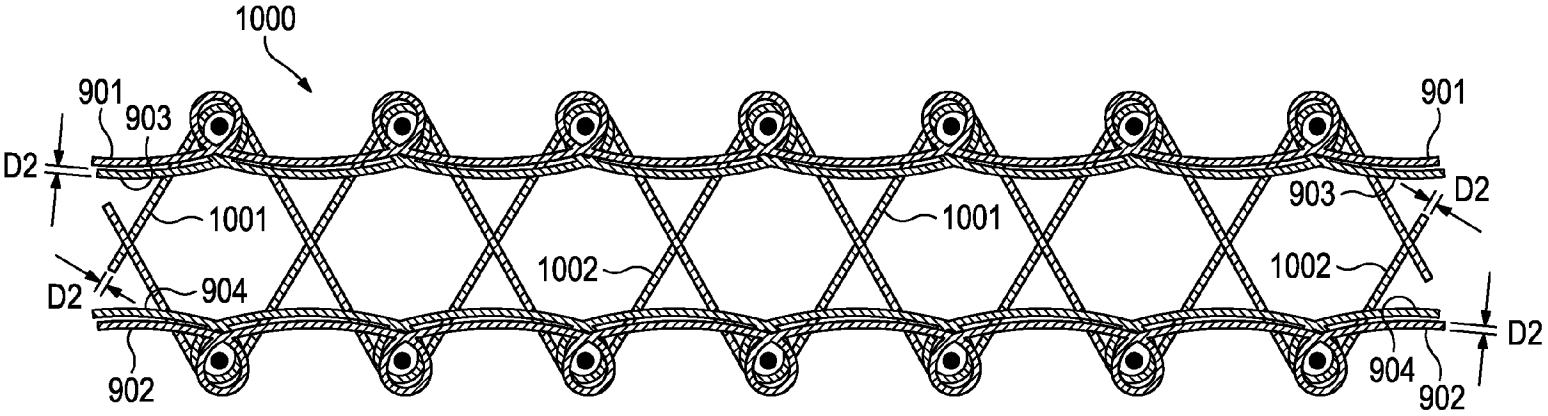
FIG. 10 is a schematic view of a third exemplary embodiment of a knit structure for a monofilament knit element.
Figure 11:
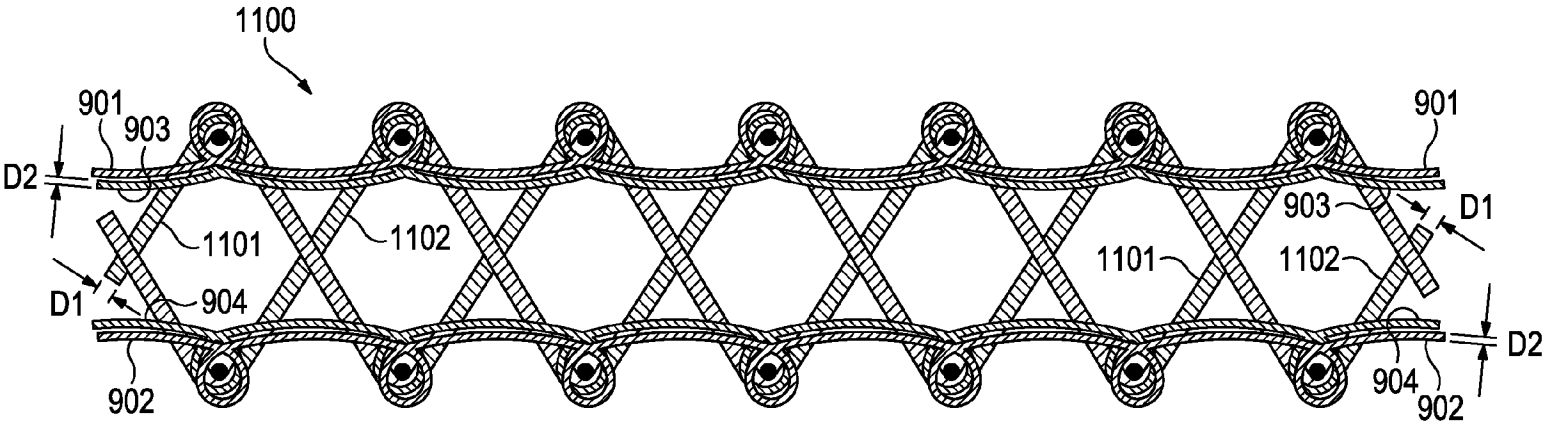
FIG. 11 is a schematic view of a fourth exemplary embodiment of a knit structure for a monofilament knit element.
Figure 12:
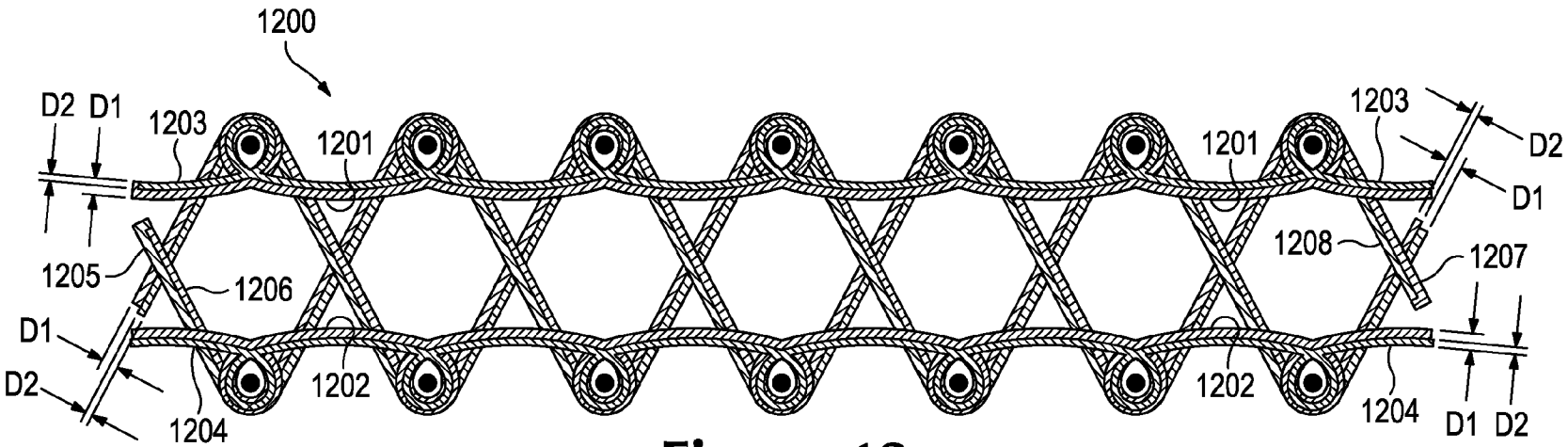
FIG. 12 is a schematic view of a fifth exemplary embodiment of a knit structure for a monofilament knit element.

In some embodiments, the opposite knitted layers of monofilament knit element 131 may be interlocked with each other at one or more portions to form knitted component 130. In an exemplary embodiment, a knit structure having a plurality of cross tuck stitches that extend between the knitted layers to connect and interlock the layers to each other. FIGS. 10 through 12 illustrate various configurations of knit structures including cross tuck stitches extending between opposite knitted layers for forming monofilament knit element 131.

Referring now to FIG. 10, an exemplary embodiment of a third knit structure 1000 including a cross tuck stitch is illustrated. In this embodiment, third knit structure 1000 may have a substantially similar configuration as second knit structure 900, described above, including first monofilament strand 901 and second monofilament strand 903 forming the first knitted layer, and third monofilament strand 902 and fourth monofilament strand 904 forming the second knitted layer. In contrast to second knit structure 900, however, third knit structure 1000 further includes one or more monofilament strands that extend back and forth between the first knitted layer and the second knitted layer to interlock the separate layers with each other. In this embodiment, third knit structure 1000 includes a first monofilament tuck strand 1001 and a second monofilament tuck strand 1002. In an exemplary embodiment, first monofilament tuck strand 1001 and second monofilament tuck strand 1002 may alternately extend back and forth between the first knitted layer formed by first monofilament strand 901 and second monofilament strand 903 and the second knitted layer formed by third monofilament strand 902 and fourth monofilament strand 904. In one embodiment, first monofilament tuck strand 1001 and second monofilament tuck strand 1002 may be joined through knitting to the first knitted layer and the second knitted layer using a cross tuck stitch, so as to form monofilament knit element 131.

In an exemplary embodiment, first monofilament tuck strand 1001 and second monofilament tuck strand 1002 may be formed from the same type of monofilament strand. In addition, in some embodiments, first monofilament tuck strand 1001 and second monofilament tuck strand 1002 may be the same monofilament strand as one or more of first monofilament strand 901, second monofilament strand 903, third monofilament strand 902, and/or fourth monofilament strand 904. In other words, in third knit structure 1000, the same monofilament strand used for the first knitted layer and/or the second knitted layer may also be used to form the cross tuck stitches extending between the knitted layers. In other embodiments, the monofilament strand forming first monofilament tuck strand 1001 and second monofilament tuck strand 1002 may be a separate strand from first monofilament strand 901, second monofilament strand 903, third monofilament strand 902, and/or fourth monofilament strand 904.

In an exemplary embodiment, first monofilament tuck strand 1001 and second monofilament tuck strand 1002 may be associated with second diameter D2. In some cases, first monofilament tuck strand 1001 and second monofilament tuck strand 1002 may be portions of the same monofilament strand. In other cases, first monofilament tuck strand 1001 and second monofilament tuck strand 1002, may be separate strands of the same type of monofilament strand.

In some embodiments, first monofilament tuck strand 1001 and second monofilament tuck strand 1002 extending between the first knitted layer and the second knitted layer of monofilament knit element 131 not only serve to interlock the layers, but also further act to provide an amount of resiliency to monofilament knit element 131. For example, the plurality of cross tuck stitches formed by first monofilament tuck strand 1001 and second monofilament tuck strand 1002 extending between the opposite knitted layers may act as a spring to resist compression and return to an uncompressed configuration. With this configuration, third knit structure 1000 may provide additional cushioning and/or padding compared with first knit structure 800 and/or second knit structure 900 that do not include cross tuck stitches. In an exemplary embodiment, by providing third knit structure 1000 with first monofilament tuck strand 1001 and second monofilament tuck strand 1002 that extend between opposite knitted layers of monofilament knit element 131, areas of knitted component 130 may be provided with additional padding or cushioning.

In some embodiments, the type of monofilament strand used for the cross tuck stitches extending between the knitted layers may be varied. For example, by varying the thickness of the monofilament strand used to form the cross tuck stitches, the amount or degree of cushioning may be similarly varied. In some cases, by providing a thinner monofilament strand for the cross tuck stitches, a smaller degree of resiliency may be provided between the knitted layers, thereby making monofilament knit element 131 easier to compress. In other cases, by providing a thicker monofilament strand for the cross tuck stitches, a larger degree of resiliency may be provided between the knitted layers, thereby making monofilament knit element 131 harder to compress and providing additional or increased padding and/or cushioning.

Referring now to FIG. 11, a fourth knit structure 1100 including a cross tuck stitch is illustrated. In an exemplary embodiment, fourth knit structure 1100 includes one or more monofilament strands used for forming the cross tuck stitches between the first and second knitted layers that provide additional padding and/or cushioning compared with third knit structure 1000. In this embodiment, fourth knit structure 1100 may have a substantially similar configuration as second knit structure 900, described above, including first monofilament strand 901 and second monofilament strand 903 forming the first knitted layer, and third monofilament strand 902 and fourth monofilament strand 904 forming the second knitted layer. In addition, similar to third knit structure 1000, fourth knit structure 1100 further includes one or more monofilament strands that extend back and forth between the first knitted layer and the second knitted layer to interlock the separate layers with each other. In this embodiment, fourth knit structure 1100 includes a third monofilament tuck strand 1101 and a fourth monofilament tuck strand 1102. In an exemplary embodiment, third monofilament tuck strand 1101 and fourth monofilament tuck strand 1102 may alternately extend back and forth between the first knitted layer formed by first monofilament strand 901 and second monofilament strand 903 and the second knitted layer formed by third monofilament strand 902 and fourth monofilament strand 904. In one embodiment, third monofilament tuck strand 1101 and fourth monofilament tuck strand 1102 may be joined through knitting to the first knitted layer and the second knitted layer using a cross tuck stitch, so as to form monofilament knit element 131.

In an exemplary embodiment, third monofilament tuck strand 1101 and fourth monofilament tuck strand 1102 may be formed from the same type of monofilament strand. In contrast to third knit structure 1000, however, in some embodiments, third monofilament tuck strand 1101 and fourth monofilament tuck strand 1102 may be a thicker monofilament strand than any of first monofilament strand 901, second monofilament strand 903, third monofilament strand 902, and/or fourth monofilament strand 904. In an exemplary embodiment, third monofilament tuck strand 1101 and fourth monofilament tuck strand 1102 may be associated with first diameter D1. As described above, in one embodiment, first diameter D1 may be approximately 0.125 mm, while second diameter may be approximately 0.08 mm. In some cases, third monofilament tuck strand 1101 and fourth monofilament tuck strand 1102 may be portions of the same monofilament strand. In other cases, third monofilament tuck strand 1101 and fourth monofilament tuck strand 1102, may be separate strands of the same type of monofilament strand.

With this configuration, by providing third monofilament tuck strand 1101 and fourth monofilament tuck strand 1102 having thicker first diameter D1 forming the cross tuck stitches between the first knitted layer formed by first monofilament strand 901 and second monofilament strand 903 and the second knitted layer formed by third monofilament strand 902 and fourth monofilament strand 904 having a thinner second diameter D2, fourth knit structure 1100 may provide additional or increased padding and/or cushioning to areas of monofilament knit element 131.

In some embodiments, a combination of monofilament strands having different thicknesses may be used to form the knit structure of monofilament knit element 131. For example, in an exemplary embodiment, two separate strands or ends of monofilament each having a different thickness may be used to form a knit structure for monofilament knit element 131. Referring now to FIG. 12, a fifth knit structure 1200 including a combination of two different thickness of monofilament strands is illustrated. In this embodiment, fifth knit structure 1200 is formed using two monofilament strands that are run together through a dispensing tip of a feeder on the knitting machine such that each stitch of fifth knit structure 1200 may be formed using the two monofilament strands together. In an exemplary embodiment, fifth knit structure 1200 includes a first thick monofilament strand 1201 and a first thin monofilament strand 1203 that are combined to knit the first knitted layer of fifth knit structure 1200 on the first needle bed. Similarly, fifth knit structure 1200 includes a second thick monofilament strand 1202 and a second thin monofilament strand 1204 that are combined to knit the second knitted layer of fifth knit structure 1200 on the second needle bed, opposite the first knitted layer.

In an exemplary embodiment, first thick monofilament strand 1201 and second thick monofilament strand 1202 may have first diameter D1, described above, while first thin monofilament strand 1203 and second thin monofilament strand 1204 may have second diameter D2, described above. In addition, in some embodiments, first thick monofilament strand 1201 and second thick monofilament strand 1202 may be formed from portions of the same monofilament strand, and first thin monofilament strand 1203 and second thin monofilament strand 1204 may also be formed from portions of the same monofilament strand, different from the monofilament strand forming first thick monofilament strand 1201 and second thick monofilament strand 1202. In other embodiments, however, each of first thick monofilament strand 1201, second thick monofilament strand 1202, first thin monofilament strand 1203, and second thin monofilament strand 1204 may be formed from separate monofilament strands.

In some embodiments, fifth knit structure 1200 may further include one or more monofilament strands that extend back and forth between the first knitted layer and the second knitted layer to interlock the separate layers with each other, similar to the cross tuck stitches associated with third knit structure 1000 and/or fourth knit structure 1100, described above. In an exemplary embodiment, fifth knit structure 1200 may include pairs of monofilament strands having different thickness that alternately extend between the opposite knitted layers and form cross tuck stitches. In this embodiment, fifth knit structure 1200 includes a first thick monofilament tuck strand 1205 and a first thin monofilament tuck strand 1206 running together between the knitted layers, and a second thick monofilament tuck strand 1207 and a second thin monofilament tuck strand 1208 running together between the knitted layers.

In an exemplary embodiment, first thick monofilament tuck strand 1205 and first thin monofilament tuck strand 1206 may alternately extend back and forth between the first knitted layer formed by first thick monofilament strand 1201 and first thin monofilament strand 1203 and the second knitted layer formed by second thick monofilament strand 1202 and second thin monofilament strand 1204. Similarly, second thick monofilament tuck strand 1207 and second thin monofilament tuck strand 1208 may alternately extend back and forth between the first knitted layer and the second knitted layer in an opposite direction as first thick monofilament tuck strand 1205 and first thin monofilament tuck strand 1206. In one embodiment, first thick monofilament tuck strand 1205 and first thin monofilament tuck strand 1206 and second thick monofilament tuck strand 1207 and second thin monofilament tuck strand 1208 may be joined through knitting to the first knitted layer and the second knitted layer using a cross tuck stitch, so as to form monofilament knit element 131.

In one embodiment, the same combination of two ends of monofilament strands having different thicknesses may be used to form all of the various portions of fifth knit structure 1200. That is, the same combination of a thick monofilament strand having first diameter D1 and a thin monofilament strand having second diameter D2 may form the first knitted layer, the second knitted layer, as well as the cross tuck stitches extending between the first knitted layer and the second knitted layer. With this configuration for fifth knit structure 1200, only a single feeder including a spool having the two strands or ends of thick monofilament strand having first diameter D1 and thin monofilament strand having second diameter D2 is needed to knit the entire area of monofilament knit element 131 having fifth knit structure 1200. By only using a single feeder, the knitting process may be made more efficient and less time consuming for knitting knitted component 130 including monofilament knit element 131 than other knit structures that require multiple feeders and/or multiple spools of knitting material.

In various embodiments, any one or more of the knit structures described above in reference to FIGS. 8 through 12 may be usable together to form different areas of monofilament knit element 131 in knitted component 130. That is, in some embodiments, different areas of monofilament knit element 131 may incorporate different knit structures, including first knit structure 800, second knit structure 900, third knit structure 1000, fourth knit structure 1100, and/or fifth knit structure 1200, as well as other types of knit structures not disclosed herein but that are known in the art. Accordingly, knitted component 130 including monofilament knit element 131 with different knit structures may be provided with varying characteristics depending on the choice of knit structure in a particular area of monofilament knit element 131.

As described above with reference to knitted component 130, in some embodiments knitted component 130 may further include fusible strands. When a fusible strand is heated and fused to non-fusible yarns or non-fusible strands, this process may have the effect of stiffening or rigidifying the structure of knitted component 130. Moreover, by joining (a) one portion of a non-fusible yarn or strand to another portion of a non-fusible yarn or strand, and/or (b) non-fusible yarn or strand and inlaid tensile element 132 to each other has the effect of securing or locking the relative positions of non-fusible yarns or strands and inlaid tensile element 132, thereby imparting stretch-resistance and stiffness. That is, portions of non-fusible yarns or strands may not slide relative to each other when fused with fusible strands, thereby preventing warping or permanent stretching of monofilament knit element 131 due to relative movement of the knit structure. Additionally, inlaid tensile element 132 may not slide relative to monofilament knit element 131, thereby preventing portions of inlaid tensile element 132 from pulling outward from monofilament knit element 131. Accordingly, areas of knitted component 130 may be configured with both fusible and non-fusible yarns or strands within monofilament knit element 131.

Figure 13:
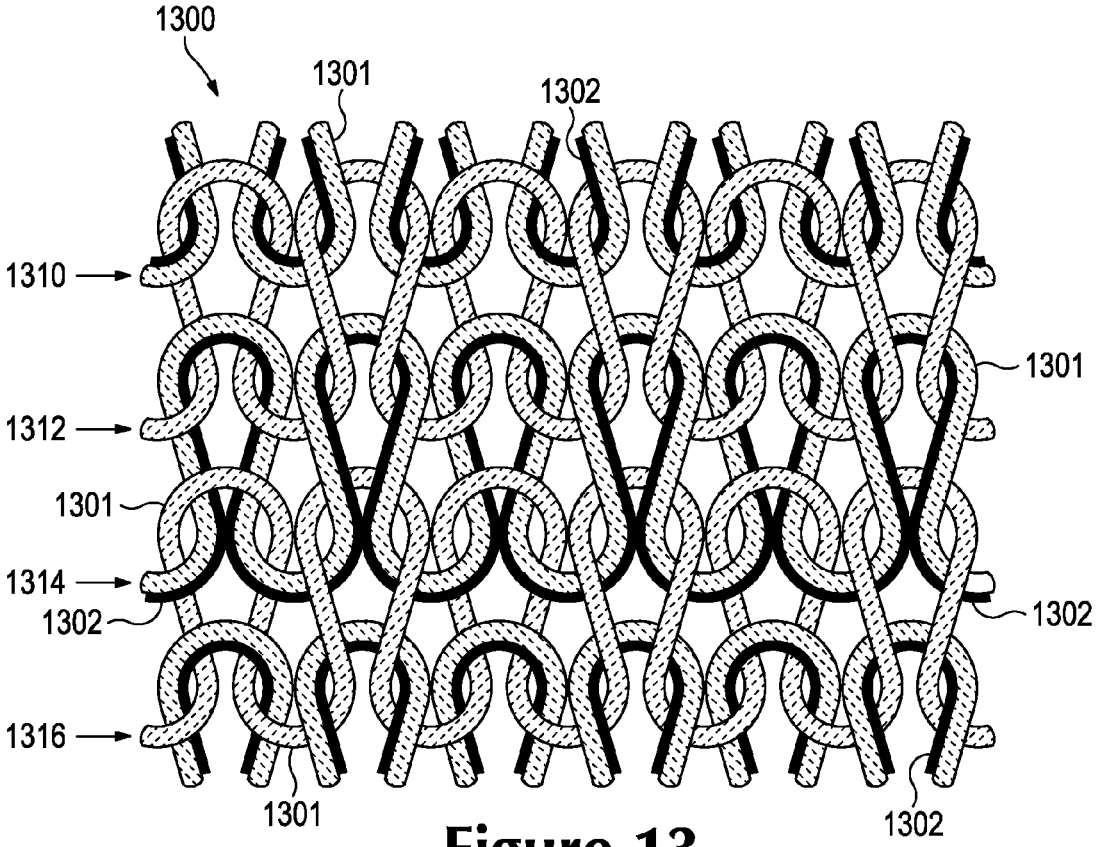
FIG. 13 is an enlarged view of a portion of a monofilament knit element including a fusible strand.

FIGS. 13 through 15B illustrate an exemplary embodiment of a knitted component that incorporates a fusible strand within a knit element, such as monofilament knit element 131. Referring now to FIG. 13, a knit element 1300 incorporating one or more fusible strands combined with non-fusible strands is illustrated. In some embodiments, knit element 1300 may include a monofilament strand 1301 and a fusible strand 1302. In an exemplary embodiment, monofilament strand 1301 may be any of the monofilament strands in the exemplary embodiments described above. As seen in FIG. 13, knit element 1300 is formed by joining through knitting portions of monofilament strand 1301 and fusible strand 1302 along a plurality of courses to form knit element 1300.

In this embodiment, both of monofilament strand 1301 and fusible strand 1302 may be in the form of a monofilament strand that is extruded from a plastic or polymer material to form the monofilament strand. In one embodiment, monofilament strand 1301 may be made from a thermoset polymer material and fusible strand may be made from a thermoplastic polymer material. In an exemplary embodiment, the polymer materials forming monofilament strand 1301 and fusible strand 1302 may be compatible materials capable of bonding to each other when the thermoplastic polymer material cools after reaching its glass transition temperature. However, in other embodiments, the polymer materials forming monofilament strand 1301 and fusible strand 1302 may be incompatible materials such that only portions of fusible strand 1302 in contact with other portions of fusible strand 1302 may bond.

In one embodiment, fusible strand 1302 may be provided along with monofilament strand 1301 only in alternating courses of knit element 1300. For example, as shown in FIG. 13, knit element 1300 includes a first course 1310, a second course 1312, a third course 1314, and a fourth course 1316. Each of the courses include portions of monofilament strand 1301 that are joined by knitting to adjacent courses of monofilament strand 1301. However, fusible strand 1302 runs along with monofilament strand 1301 only on every other course. According, in this embodiment, fusible strand 1302 is included in first course 1310 and third course 1314, but is not present in second course 1312 and/or fourth course 1316. With this alternating configuration of fusible strand 1302, no portion of fusible strand 1302 from adjacent courses of knit element 1300 will be joined by knitting to another portion of fusible strand 1302. For example, as shown in FIG. 13, the portion of fusible strand 1302 extending along first course 1310 will not be joined to the portion of fusible strand 1302 extending along third course 1314. In some embodiments, knit element 1300 may continue with alternating courses of fusible strand 1302 for any amount of courses.

By providing alternating courses of fusible strand 1302 in knit element 1300 including monofilament strand 1301, fusible strand 1302 may assist with bonding portions of monofilament strand 1301 to adjacent portions of monofilament strand 1301 to set or secure the configuration of knit element 1300. However, by providing only alternating courses with fusible strand 1302, the overall weight and thickness of knit element 1300 may be reduced compared with a knit element that includes fusible yarns or strands in all adjacent courses.

Figure 14A:
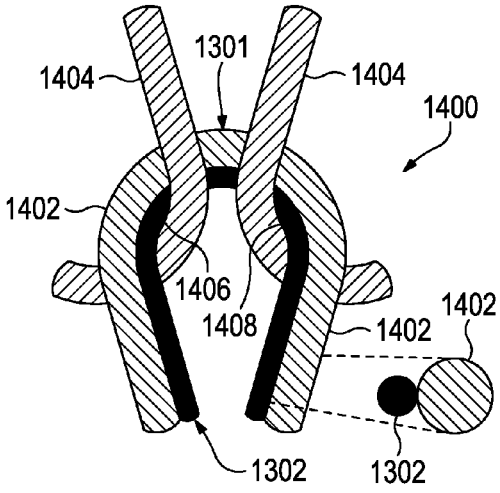
FIG. 14A is a schematic view of interlooped portions of a monofilament knit element including a fusible strand in an unheated configuration.

Additionally, the combination of fusible strand 1302 and monofilament strand 1301 may take on the form a combined strand when knit element 1300 including fusible strand 1302 is heated. FIGS. 14A, 14B and FIGS. 15A, 15B illustrate different configurations of unheated and heated knit elements including a fusible strand or yarn. Referring now to FIG. 14A, an unheated configuration 1400 of knit element 1300 is illustrated. In this embodiment, one of the courses including monofilament strand 1301 and fusible strand 1302 is joined to an adjacent course including only monofilament strand 1301. For example, a first monofilament strand portion 1402 and fusible strand 1302 run together along one course and a second monofilament strand portion 1404 extends alone along the adjacent course. As seen in FIG. 14A, fusible strand 1302 may contact second monofilament strand portion 1404 at a first contact point 1406 and a second contact point 1408 that join the adjacent courses together. In this embodiment, fusible strand 1302 remains separate from monofilament strand 1301 in unheated configuration 1400.

Figure 14B:
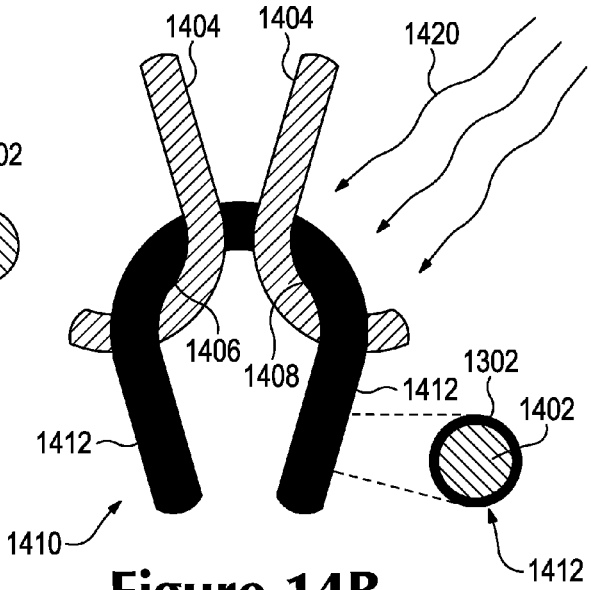
FIG. 14B is a schematic view of interlooped portions of a monofilament knit element including a fusible strand in a heated configuration.

In some embodiments, when heat is applied to fusible strand 1302 sufficient for fusible strand 1302 to reach its glass transition temperature and become substantially plastic, fusible strand 1302 may attach or bond with monofilament strand 1301 so as to form a combined strand. Referring now to FIG. 14B, a heated configuration 1410 of knit element 1300 is illustrated. In this embodiment, heat 1420 from a heat source (not shown) has been applied to fusible strand 1302 and monofilament strand 1301. If heat 1420 is sufficient to allow fusible strand 1302 to reach its glass transition temperature and become substantially plastic, fusible strand 1302 may then melt and surround portions of monofilament strand 1301 to form a combined strand 1412.

As shown in FIG. 14B, in heated configuration 1410, fusible strand 1302 has melted and surrounded first monofilament strand portion 1402 to form combined strand 1412. With this configuration, fusible strand 1302 may act as a coating layer at least partially or wholly surrounding monofilament strand 1301 in the resulting combined strand 1412.

Figure 15A:
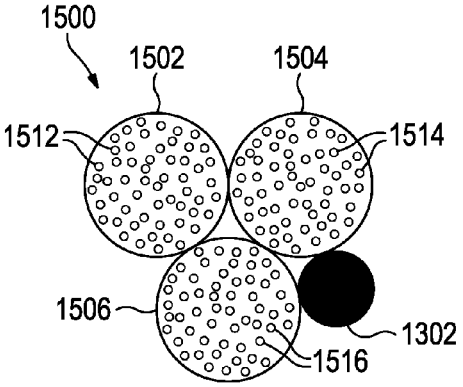
FIG. 15A is a schematic view of an unheated configuration of fiber yarns and a fusible strand.

Using a monofilament strand, for example, monofilament strand 1301, with a fusible strand, for example, fusible strand 1302, that have relatively similar diameters allows the fusible strand to substantially coat and surround the monofilament strand. In contrast, when using a fusible strand or yarn in combination with a conventional natural or synthetic twisted fiber yarn or yarns, the fusible strand may infiltrate and bond with only a portion of the natural or synthetic twisted fiber yarn or yarns. Referring now to FIG. 15A, an unheated configuration 1500 of a knit element including natural or synthetic twisted fiber yarns is illustrated. In this embodiment, fusible strand 1302 is combined with a plurality of natural or synthetic twisted fiber yarns. For example, a first natural or synthetic twisted fiber yarn 1502, a second natural or synthetic twisted fiber yarn 1504, and a third natural or synthetic twisted fiber yarn 1506 are combined with a single fusible strand 1302. This combination may be run together along one or more courses to form a knit element for a fiber yarn upper.

As seen in FIG. 15A, each natural or synthetic twisted fiber yarn may further include a plurality of individual filaments that together are twisted and combined to form a single yarn. In this embodiment, first natural or synthetic twisted fiber yarn 1502 includes a first plurality of filaments 1512, second natural or synthetic twisted fiber yarn 1504 includes a second plurality of filaments 1514, and third natural or synthetic twisted fiber yarn 1506 includes a third plurality of filaments 1516. Fusible strand 1302 may contact only a few of the natural or synthetic twisted fiber yarns. For example, in this embodiment, fusible strand 1302 contacts second natural or synthetic twisted fiber yarn 1504 and third natural or synthetic twisted fiber yarn 1506, but does not contact first natural or synthetic twisted fiber yarn 1502.

Figure 15B:
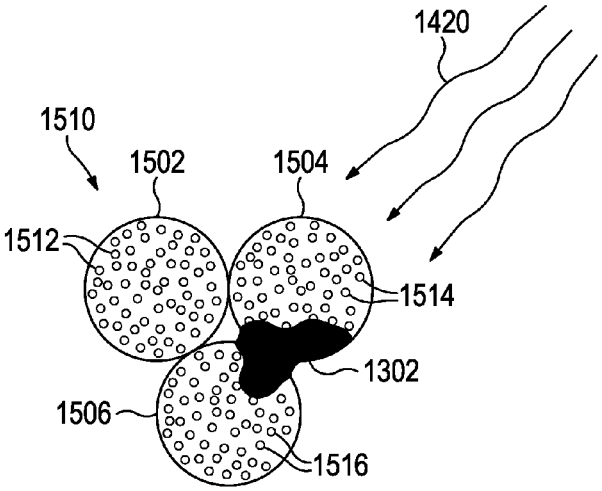
FIG. 15B is a schematic view of a heated configuration of fiber yarns and a fusible strand.

Accordingly, when heat is applied to fusible strand 1302 sufficient for fusible strand 1302 to reach its glass transition temperature and become substantially plastic, fusible strand 1302 may attach or bond with only portions of adjacent natural or synthetic twisted fiber yarns. Referring now to FIG. 15B, a heated configuration 1510 of a knit element for a fiber yarn upper is illustrated. In this embodiment, heat 1420 from a heat source (not shown) has been applied to fusible strand 1302 and the plurality of natural or synthetic twisted fiber yarns. If heat 1420 is sufficient to allow fusible strand 1302 to reach its glass transition temperature and become substantially plastic, fusible strand 1302 may then melt and infiltrate portions of the adjacent natural or synthetic twisted fiber yarns. As shown in FIG. 15B, in heated configuration 1510, fusible strand 1302 has melted and infiltrated into only a portion of second plurality of filaments 1514 of second natural or synthetic twisted fiber yarn 1504, and a portion of third plurality of filaments 1516 of third natural or synthetic twisted fiber yarn 1506. In this embodiment, fusible yarn 1302 has not bonded or infiltrated into any portion of first plurality of filaments 1512 of first natural or synthetic twisted fiber yarn 1502.

In contrast with heated configuration 1410 shown in FIG. 14B above, therefore, using fusible strand 1302 with natural or synthetic twisted fiber yarns does not form a combined yarn or strand as combined strand 1412, described above.

The features of the exemplary embodiments described above with regard to fusible strand 1302 and FIGS. 13 through 14B may be used with any of the previously described embodiments, including embodiments of knit structures shown in FIGS. 8 through 12 and embodiments of a knitted component, including knitted component 130 shown in FIGS. 1 through 7 above. In addition, other embodiments of knitted components and knit structures made according to the features of the disclosed embodiments may be made other than those shown here.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A knitted component comprising: a monofilament knit element formed by at least one monofilament strand, wherein the monofilament knit element comprises alternating courses including (1) the at least one monofilament strand and a fusible strand, and (2) the at least one monofilament strand without the fusible strand;

wherein the alternating courses include at least a first course, a second course, and a third course; wherein the first course comprises the at least one monofilament strand and the fusible strand, the first course being continuous with the second course; wherein the second course comprises the at least one monofilament strand without the fusible strand, the second course being continuous with the third course; wherein the third course comprises the at least one monofilament strand and the fusible strand; and wherein the second course is disposed between the first course and the third course, and wherein the fusible strand at least partially covers the at least one monofilament strand upon heating the monofilament knit element to at least a glass transition temperature of the fusible strand.

2. The knitted component of claim 1, wherein the at least one monofilament strand and the fusible strand have substantially similar diameters.

3. The knitted component of claim 1, wherein the at least one monofilament strand is made of a thermoset polymer material and the fusible strand is made of a thermoplastic polymer material.

4. The knitted component of claim 1, wherein the at least one monofilament strand consists of a single monofilament strand and the fusible strand consists of a single monofilament strand formed from thermoplastic polymer material.

5. The knitted component of claim 1, wherein the monofilament knit element defines substantially all of an exterior surface of an upper of an article of footwear and an opposite interior surface of the upper, the interior surface defining a void for receiving a foot; and wherein the monofilament knit element extends (a) through each of a forefoot region, a midfoot region, and a heel region of the article of footwear, and (b) across a top of the upper between a medial side and a lateral side of the article of footwear.

6. The knitted component of claim 1, wherein a first monofilament strand of the at least one monofilament strand and the fusible strand are adjacent to each other and run together along a course of the monofilament knit element in an unheated configuration of the knitted component.

7. The knitted component of claim 6, wherein the first monofilament strand of the at least one monofilament strand and the fusible strand are at least partially combined together along a course of the monofilament knit element to form a combined strand in a heated configuration of the knitted component, the heated configuration being at least the glass transition temperature of the fusible strand.

8. The knitted component of claim 7, wherein the combined strand comprises an outer layer of the fusible strand surrounding a portion of the first monofilament strand.

9. A method of manufacturing a knitted component, the method comprising: knitting a monofilament knit element using at least one monofilament strand;

wherein the step of knitting the monofilament knit element further comprises: knitting alternating courses including (1) the at least one monofilament strand and the fusible strand, and (2) the at least one monofilament strand without the fusible strand such that a first course comprising the at least one monofilament strand and the fusible strand is continuous with a second course comprising the at least one monofilament strand without the fusible strand, and the second course is continuous with a third course comprising the at least one monofilament strand and the fusible strand; and wherein the second course is disposed between the first course and the third course; and wherein the fusible strand at least partially covers the at least one monofilament strand upon heating the monofilament knit element to at least a glass transition temperature of the fusible strand.

10. The method according to claim 9, wherein the monofilament knit element is knitted exclusively using the at least one monofilament strand and the fusible strand, the at least one monofilament strand and the fusible strand having substantially similar diameters.

11. The method according to claim 9, wherein the method is performed using a knitting machine; and wherein the step of knitting the at least one course of the monofilament knit element using the fusible strand further comprises: knitting a course of the monofilament knit element using a first monofilament strand and the fusible strand that run together from a dispending tip of a feeder of the knitting machine.

12. The method according to claim 9, further comprising heating the knitted component including the fusible strand.

13. The method according to claim 12, wherein the step of heating the knitted component further comprises providing an amount of heat sufficient to reach a glass transition temperature of a thermoplastic polymer material forming the fusible strand; and wherein the first monofilament strand of the at least one monofilament strand and the fusible strand are at least partially combined together along a course of the monofilament knit element to form a combined strand after the thermoplastic polymer material cools from the glass transition temperature.

* * * * *